US009462399B2

(12) United States Patent
Bharitkar et al.

(10) Patent No.: US 9,462,399 B2
(45) Date of Patent: Oct. 4, 2016

(54) AUDIO PLAYBACK SYSTEM MONITORING

(75) Inventors: Sunil Bharitkar, Los Angeles, CA (US); Brett G. Crockett, Brisbane, CA (US); Louis D. Fielder, Millbrae, CA (US); Michael Rockwell, Palo Alto, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 177 days.

(21) Appl. No.: 14/126,985

(22) PCT Filed: Jun. 27, 2012

(86) PCT No.: PCT/US2012/044342

§ 371 (c)(1),
(2), (4) Date: Dec. 17, 2013

(87) PCT Pub. No.: WO2013/006324

PCT Pub. Date: Jan. 10, 2013

(65) Prior Publication Data

US 2014/0119551 A1 May 1, 2014

Related U.S. Application Data

(60) Provisional application No. 61/504,005, filed on Jul. 1, 2011, provisional application No. 61/635,934, filed on Apr. 20, 2012, provisional application No. 61/655,292, filed on Jun. 4, 2012.

(51) Int. Cl.

| | |
|---|---|
| ***H04R 29/00*** | (2006.01) |
| ***H04H 60/33*** | (2008.01) |
| ***H04H 60/04*** | (2008.01) |

(52) U.S. Cl.

CPC ..... *H04R 29/001* (2013.01); *H04H 60/04* (2013.01); *H04H 60/33* (2013.01); *H04R 29/002* (2013.01)

(58) Field of Classification Search

None

See application file for complete search history.

(56) References Cited

U.S. PATENT DOCUMENTS

| | | | |
|---|---|---|---|
| 7,158,643 | B2 | 1/2007 | Lavoie |
| 7,525,440 | B2 | 4/2009 | Carreras |

(Continued)

FOREIGN PATENT DOCUMENTS

| | | |
|---|---|---|
| DE | 19901288 | 7/2000 |
| EP | 1956865 | 8/2008 |

(Continued)

OTHER PUBLICATIONS

Cheng, Yi-Hsiang, et al. "Pre-Processing Scheme to Effectively Compensate Environment and Equipment Factors for Sound Source Separation" IEEE Region 10 Annual International Conference Proceedings, pp. 2072-2076, 2010.

(Continued)

*Primary Examiner* — Thang Tran

(57) ABSTRACT

In some embodiments, a method for monitoring speakers within an audio playback system (e.g., movie theater) environment. In typical embodiments, the monitoring method assumes that initial characteristics of the speakers (e.g., a room response for each of the speakers) have been determined at an initial time, and relies on one or more microphones positioned in the environment to perform a status check on each of the speakers to identify whether a change to at least one characteristic of any of the speakers has occurred since the initial time. In other embodiments, the method processes data indicative of output of a microphone to monitor audience reaction to an audiovisual program. Other aspects include a system configured (e.g., programmed) to perform any embodiment of the inventive method, and a computer readable medium (e.g., a disc) which stores code for implementing any embodiment of the inventive method.

44 Claims, 10 Drawing Sheets

(56) References Cited

U.S. PATENT DOCUMENTS

| | | | | |
|---|---|---|---|---|
| 7,881,460 | B2 | 2/2011 | Looney | |
| 7,889,073 | B2 | 2/2011 | Zalewski | |
| 8,036,767 | B2 | 10/2011 | Soulodre | |
| 8,081,776 | B2 | 12/2011 | Haulick | |
| 8,126,161 | B2 * | 2/2012 | Togami et al. | 381/94.3 |
| 8,737,636 | B2 * | 5/2014 | Park et al. | 381/71.8 |
| 2002/0073417 | A1 | 6/2002 | Kondo | |
| 2003/0105540 | A1 * | 6/2003 | Debail | 700/94 |
| 2004/0117815 | A1 | 6/2004 | Kondo | |
| 2004/0156510 | A1 * | 8/2004 | Isaka et al. | 381/59 |
| 2004/0174991 | A1 * | 9/2004 | Hirai et al. | 379/406.08 |
| 2005/0123143 | A1 | 6/2005 | Platzer | |
| 2005/0137859 | A1 * | 6/2005 | Yoshino | 704/205 |
| 2005/0152557 | A1 * | 7/2005 | Sasaki et al. | 381/58 |
| 2005/0289582 | A1 | 12/2005 | Tavares | |
| 2006/0083387 | A1 | 4/2006 | Emoto | |
| 2006/0182287 | A1 | 8/2006 | Schulein | |
| 2006/0210093 | A1 * | 9/2006 | Ishibashi et al. | 381/80 |
| 2006/0251265 | A1 | 11/2006 | Asada | |
| 2007/0019815 | A1 * | 1/2007 | Asada et al. | 381/58 |
| 2008/0195385 | A1 | 8/2008 | Pereg | |
| 2009/0316923 | A1 | 12/2009 | Tashev | |
| 2010/0189275 | A1 * | 7/2010 | Christoph | 381/66 |
| 2010/0189292 | A1 | 7/2010 | Wurzbacher | |
| 2011/0019833 | A1 | 1/2011 | Kuech | |
| 2011/0164754 | A1 | 7/2011 | Gleissner | |
| 2012/0020505 | A1 | 1/2012 | Yamada | |

FOREIGN PATENT DOCUMENTS

| | | |
|---|---|---|
| GB | 2448766 | 10/2008 |
| RS | 1332 U | 8/2013 |
| WO | 2008/006952 | 1/2008 |
| WO | 2008/096336 | 8/2008 |
| WO | 2011/120800 | 10/2011 |

OTHER PUBLICATIONS

Usher, J. et al. "Enhancement of Spatial Sound Quality: A New Reverberation-Extraction Audio Upmixer" IEEE Transactions on Audio, Speech, and Language Processing, vol. 15, No. 7, Sep. 2007, pp. 2141-2150.

Erten, G. "Voice Signal Extraction for Enhanced Speech Quality in Noisy Vehicle Environments" Digital Avionics Systems Conference, 1999, Proc. 18th IC Tech, Inc. vol. 2.

Peltola, Leevi "Synthesis of Hand Clapping Sounds" Audio, Speech, and Language Processing, Transactions on IEEE, vol. 15, Issue 3, pp. 1021-1029, Dec. 2006.

Schuller, B. et al "Discrimination of Speech and Non-Linguistic Vocalizations by Non-Negative Matrix Factorization" IEEE International Conference on Mar. 14-19, 2010, pp. 5054-5057, ICASSP.

Davy, M. et al. "Loudspeaker Fault Detection Using Time-Frequency Representations" ICASSP IEEE INT Acoustic Speech Signal Processing 2001.

Stanojevic, T. et al "The Total Surround Sound System", 86th AES Convention, Hamburg, Mar. 7-10, 1989.

Stanojevic, T. et al "Designing of TSS Halls" 13th International Congress on Acoustics, Yugoslavia, 1989.

Stanojevic, T. et al "TSS System and Live Performance Sound" 88th AES Convention, Montreux, Mar. 13-16, 1990.

Stanojevic, Tomislav "3-D Sound in Future HDTV Projection Systems" presented at the 132nd SMPTE Technical Conference, Jacob K. Javits Convention Center, New York City, Oct. 13-17, 1990.

Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.

Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.

Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.

Stanojevic, T. et al "The Total Surround Sound (TSS) Processor" SMPTE Journal, Nov. 1994.

Stanojevic, Tomislav "Surround Sound for a New Generation of Theaters, Sound and Video Contractor" Dec. 20, 1995.

* cited by examiner

AUDIO PLAYBACK SYSTEM MONITORING

CROSS-REFERENCE OF RELATED APPLICATIONS

This application claims priority to U.S. Provisional Application No. 61/504,005 filed 1 Jul. 2011; U.S. Provisional Application No. 61/635,934 filed 20 Apr. 2012 and U.S. Provisional Application No. 61/655,292 filed 4 Jun. 2012, all of which are hereby incorporated by reference in entirety for all purposes.

TECHNICAL FIELD

The invention relates to systems and methods for monitoring audio playback systems, e.g., to monitor status of loudspeakers of an audio playback system and/or to monitor reactions of an audience to an audio program played back by an audio playback system. Typical embodiments are systems and methods for monitoring cinema (movie theater) environments (e.g., to monitor status of loudspeakers employed to render an audio program in such an environment and/or to monitor reactions of an audience to an audiovisual program played back in such an environment).

BACKGROUND

Typically, during an initial alignment process (in which a set of speakers of an audio playback system is initially calibrated), pink noise (or another stimulus such as a sweep or pseudo-random noise sequence) is played through each speaker of the system and captured by a microphone. The pink noise (or other stimulus), as emitted from each speaker and captured by a "signature" microphone placed on a sidewall/ceiling/in-room, is typically stored for use during subsequent maintenance checks (quality checks). Such a subsequent maintenance check is conventionally performed in the playback system environment (which may be a movie theater) by exhibitor staff when no audience is present, using pink noise rendered through a predetermined sequence of the speakers (whose status is to be monitored) during the check. During the maintenance check, for each speaker sequenced in the playback environment, the microphone captures the pink noise emitted by the loudspeaker, and the maintenance system identifies any difference between the initially measured pink noise (emitted from the speaker and captured during the alignment process) and the pink noise measured during the maintenance check. This can be indicative of a change in the set of speakers that has occurred since the initial alignment, such as damage to an individual driver (e.g., woofer, mid-range, or tweeter) in one of the speakers, or a change in a speaker output spectrum (relative to an output spectrum determined in the initial alignment), or a change in polarity of the output of one of the speakers, relative to a polarity determined in the initial alignment (e.g., due to replacement of a speaker). The system can also use loudspeaker-room responses deconvolved from pink-noise measurements for analysis. Additional modifications include gating or windowing the time-response to analyze the direct sound of the loudspeaker.

However, there are several limitations and disadvantages of such a conventionally implemented maintenance check, including the following: (i) it is time-consuming to run pink noise individually and sequentially through a theater's loudspeakers, and to de-convolve each corresponding loudspeaker-room impulse response from each microphone (typically located on a wall of the theater), especially since a movie theater may have as many as 26 (or more) loudspeakers; and (ii) performing the maintenance check does not aid in promoting the theater's audiovisual system format directly to an audience in the theater.

BRIEF DESCRIPTION OF EXEMPLARY EMBODIMENTS

In some embodiments, the invention is a method for monitoring loudspeakers within an audio playback system (e.g., movie theater) environment. In a typical embodiment in this class, the monitoring method assumes that initial characteristics of the speakers (e.g., a room response for each of the speakers) have been determined at an initial time, and relies on one or more microphones positioned (e.g., on a side wall) within the environment to perform a maintenance check (sometimes referred to herein as a quality check or "QC" or status check) on each of the loudspeakers in the environment to identify whether a change to at least one characteristic of any of the loudspeakers has occurred since the initial time (e.g., since an initial alignment or calibration of the playback system). The status check can be performed periodically (e.g., daily).

In a class of embodiments, trailer-based loudspeaker quality checks (QCs) are performed on the individual loudspeakers of a theater's audio playback system during playback of an audiovisual program (e.g., a movie trailer or other entertaining audiovisual program) to an audience (e.g., before a movie is played to the audience). Since it is contemplated that the audiovisual program is typically a movie trailer, it will often be referred to herein as a "trailer." In one embodiment, the quality check identifies (for each loudspeaker of the playback system) any difference between a template signal (e.g., a measured initial signal captured by a microphone in response to playback of the trailer's soundtrack by the speaker at an initial time, e.g., during a speaker calibration or alignment process), and a measured signal (sometimes referred to herein as a status signal or "QC" signal) captured by the microphone in response to playback (by the speakers of the playback system) of the trailer's soundtrack during the quality check. In another embodiment, typical loudspeaker-room responses are obtained during the initial calibration step for theater equalization. The trailer signal is then filtered in a processor by the loudspeaker-room responses (which may in turn be filtered with the equalization filter), and summed with another appropriate loudspeaker-room equalized response filtering a corresponding trailer signal. The resulting signal at the output then forms the template signal. The template signal is compared against the captured signal (called the status signal in the following text) when the trailer is rendered in the presence of an audience.

When the trailer includes subject matter which promotes the format of the theater's audiovisual system, a further advantage (to the entity which sells and/or licenses the audiovisual system, as well as to the theater owner) of using such trailer-based loudspeaker QC monitoring is that it incentivizes theater owners to play the trailer to facilitate performance of the quality check while simultaneously providing a significant benefit of promoting (e.g., marketing, and/or increasing audience awareness of) the audiovisual system format.

Typical embodiments of the inventive, trailer-based, loudspeaker quality check method extract individual loudspeaker characteristics from a status signal captured by a microphone during playback of the trailer by all speakers of a playback system during a status check (sometimes referred to herein as a quality check or QC). In typical embodiments, the status signal obtained during the status check is essentially a linear combination of all the room-response convolved loudspeaker output signals (one for each of the loudspeakers which emits sound during playback of the trailer during the status check) at the microphone. Any failure mode detected by the QC by processing of the status signal is typically conveyed to the theater owner and/or used by a decoder of the theater's audio playback system to change a rendering mode in case of loudspeaker failure.

In some embodiments, the inventive method includes a step of employing a source separation algorithm, a pattern matching algorithm, and/or unique fingerprint extraction from each loudspeaker, to obtain a processed version of the status signal which is indicative of sound emitted from an individual one of the loudspeakers (rather than a linear combination of all the room-response convolved loudspeaker output signals). Typical embodiments, however, implement a cross-correlation/PSD (power spectral density) based approach to monitor status of each individual speaker in the playback environment from a status signal indicative of sound emitted from all the speakers in the environment (without employing a source separation algorithm, a pattern matching algorithm, or unique fingerprint extraction from each speaker).

The inventive method can be performed in home environments as well as in cinema environments, e.g., with the required signal processing of microphone output signals being performed in a home theater device (e.g., an AVR or Blu-ray player that is shipped to the user with the microphone to be employed to perform the method).

Typical embodiments of the invention implement a cross-correlation/power spectral density (PSD) based approach to monitor status of each individual speaker in the playback environment (which is typically a movie theater) from a status signal which is a microphone output signal indicative of sound captured during playback (by all the speakers in the environment) of an audiovisual program. The audiovisual program will be referred to below as a trailer, since it is typically a movie trailer. For example, a class of embodiments of the inventive method includes the steps of:

(a) playing back a trailer whose soundtrack has N channels (which may be speaker channels or object channels), where N is a positive integer (e.g., an integer greater than one), including by emitting sound, determined by the trailer, from a set of N speakers positioned in the playback environment in response to driving each of the speakers with a speaker feed for a different one of the channels of the soundtrack. Typically, the trailer is played back in the presence of an audience in a movie theater;

(b) obtaining audio data indicative of a status signal captured by each microphone of a set of M microphones in the playback environment during emission of the sound in step (a), where M is a positive integer (e.g., M=1 or 2). In typical implementations, the status signal for each microphone is the analog output signal of the microphone during step (a), and the audio data indicative of the status signal are generated by sampling the output signal. Preferably, the audio data are organized into frames having a frame size adequate to obtain sufficient low frequency resolution, and the frame size is preferably sufficient to ensure the presence of content from all channels of the soundtrack in each frame; and (c) processing the audio data to perform a status check on each speaker of the set of N speakers, including by comparing (e.g., identifying whether a significant difference exists between), for each said speaker and each of at least one microphone in the set of M microphones, the status signal captured by the microphone (said status signal being determined by the audio data obtained in step (b)) and a template signal, wherein the template signal is indicative (e.g., representative) of response of a template microphone to playback by the speaker, in the playback environment at an initial time, of a channel of the soundtrack corresponding to said speaker. Alternatively, the template signal (representing the response at a signature microphone or microphones) can be computed in a processor with a-priori knowledge of the loudspeaker-room responses (equalized or unequalized) from the loudspeaker to the corresponding signature microphone(s). The template microphone is positioned, at the initial time, at at least substantially the same position in the environment as is a corresponding microphone of the set during step (b). Preferably, the template microphone is the corresponding microphone of the set, and is positioned, at the initial time, at the same position in the environment as is said corresponding microphone during step (b). The initial time is a time before performance of step (b), and the template signal for each speaker is typically predetermined in a preliminary operation (e.g., a preliminary speaker alignment process), or is generated before (or during) step (b) from a predetermined room response for the corresponding speaker-microphone pair and the trailer soundtrack.

Step (c) preferably includes an operation of determining a cross-correlation (for each speaker and microphone) of the template signal for said speaker and microphone (or a bandpass filtered version of said template signal) with the status signal for said microphone (or a bandpass filtered version thereof), and identifying a difference (if any significant difference exists) between the template signal and the status signal from a frequency domain representation (e.g., power spectrum) of the cross-correlation. In typical embodiments, step (c) includes an operation (for each speaker and microphone) of applying a bandpass filter to the template signal (for the speaker and microphone) and the status signal (for the microphone), and determining (for each microphone) a cross-correlation of each bandpass filtered template signal for the microphone with the bandpass filtered status signal for the microphone, and identifying a difference (if any significant difference exists) between the template signal and the status signal from a frequency domain representation (e.g., power spectrum) of the cross-correlation.

This class of embodiments of the method assumes knowledge of the room responses of the loudspeakers (typically obtained during a preliminary operation, e.g., a speaker alignment or calibration operation) and knowledge of the trailer soundtrack. To determine the template signal employed in step (c) for each speaker-microphone pair, the following steps may be performed. The room response (impulse response) of each speaker is determined (e.g., during a preliminary operation) by measuring sound emitted from the speaker with the microphone positioned in the same environment (e.g., room) as the speaker. Then, each channel signal of the trailer soundtrack is convolved with the corresponding impulse response (the impulse response of the speaker which is driven by the speaker feed for the channel) to determine the template signal (for the microphone) for the channel. The template signal (template) for each speaker-microphone pair is a simulated version of the microphone output signal to be expected at the microphone during performance of the monitoring (quality check) method with the speaker emitting sound determined by the corresponding channel of the trailer soundtrack.

Alternatively, the following steps may be performed to determine each template signal employed in step (c) for each speaker-microphone pair. Each speaker is driven by the speaker feed for the corresponding channel of the trailer soundtrack, and the resulting sound is measured (e.g., during a preliminary operation) with the microphone positioned in the same environment (e.g., room) as the speaker. The microphone output signal for each speaker is the template signal for the speaker (and corresponding microphone), and is a template in the sense that it is the output signal to be expected at the microphone during performance of the monitoring (quality check) method with the speaker emitting sound determined by the corresponding channel of the trailer soundtrack.

For each speaker-microphone pair, any significant difference between the template signal for the speaker (which is either a measured or a simulated template), and a measured status signal captured by the microphone in response to the trailer soundtrack during performance of the inventive monitoring method, is indicative of an unexpected change in the loudspeaker's characteristics.

Typical embodiments of the invention monitor the transfer function applied by each loudspeaker to the speaker feed for a channel of an audiovisual program (e.g., a movie trailer) as measured by capturing sound emitted from the loudspeaker using a microphone, and flag when changes occur. Since a typical trailer does not cause only one loudspeaker at a time active sufficiently long to make a transfer function measurement, some embodiments of the invention employ cross correlation averaging methods to separate the transfer function of each loudspeaker from that of the other loudspeakers in the playback environment. For example, in one such embodiment the inventive method includes steps of: obtaining audio data indicative of a status signal captured by a microphone (e.g., in a movie theater) during playback of a trailer; and processing the audio data to perform a status check on the speakers employed to render the trailer, including by, for each of the speakers, comparing (including by implementing cross correlation averaging) a template signal indicative of response of the microphone to playback of a corresponding channel of the trailer's soundtrack by the speaker at an initial time, and the status signal determined by the audio data. The step of comparing typically includes identifying a difference, if any significant difference exists, between the template signal and the status signal. The cross correlation averaging (during the step of processing the audio data) typically includes steps of determining a sequence of cross-correlations (for each speaker) of the template signal for said speaker and the microphone (or a bandpass filtered version of said template signal) with the status signal for said microphone (or a bandpass filtered version of the status signal), where each of the cross-correlations is a cross-correlation of a segment (e.g., a frame or sequence of frames) of the template signal for said speaker and the microphone (or a bandpass filtered version of said segment) with a corresponding segment (e.g., a frame or sequence of frames) of the status signal for said microphone (or a bandpass filtered version of said segment), and identifying a difference (if any significant difference exists) between the template signal and the status signal from an average of the cross-correlations.

In another class of embodiments, the inventive method processes data indicative of the output of at least one microphone to monitor audience reaction (e.g., laughter or applause) to an audiovisual program (e.g., a movie played in a movie theater), and provides the resulting output data (indicative of audience reaction) to interested parties (e.g., studios) as a service (e.g., via a web connected d-cinema server). The output data can inform a studio that a comedy is doing well based on how often and how loud the audience laughs or how a serious film is doing based on whether audience members applaud at the end. The method can provide geographically based feedback (e.g., to studios) which may be used to direct advertising for promotion of a movie.

Typical embodiments in this class implement the following key techniques: (i) separation of playback content (i.e., audio content of the program played back in the presence of the audience) from each audience signal captured by each microphone (during playback of the program in the presence of the audience). Such separation is typically implemented by a processor coupled to receive the output of each microphone; and (ii) content analysis and pattern classification techniques (also typically implemented by a processor coupled to receive the output of each microphone) to discriminate between different audience signals captured by the microphone(s).

Separation of playback content from audience input can be achieved by performing a spectral subtraction (for example), where the difference is obtained between the measured signal at each microphone and a sum of filtered versions of the speaker feed signals delivered to the loudspeakers (with the filters being copies of equalized room responses of the speakers measured at the microphone). Thus, a simulated version of the signal expected to be received at the microphone in response to the program alone is subtracted from the actual signal received at the microphone in response to the combined program and audience signal. The filtering can be done with different sampling rates to get better resolution in specific frequency bands.

The pattern recognition can utilize supervised or unsupervised clustering/classification techniques.

Aspects of the invention include a system configured (e.g., programmed) to perform any embodiment of the inventive method, and a computer readable medium (e.g., a disc) which stores code for implementing any embodiment of the inventive method.

In some embodiments, the inventive system is or includes at least one microphone (each said microphone being positioned during operation of the system to perform an embodiment of the inventive method to capture sound emitted from a set of speakers to be monitored), and a processor coupled to receive a microphone output signal from each said microphone. Typically the sound is generated during playback of an audiovisual program (e.g., a movie trailer) in the presence of an audience in a room (e.g., a movie theater) by the speakers to be monitored. The processor can be a general or special purpose processor (e.g., an audio digital signal processor), and is programmed with software (or firmware) and/or otherwise configured to perform an embodiment of the inventive method in response to each said microphone output signal. In some embodiments, the inventive system is or includes a general purpose processor, coupled to receive input audio data (e.g., indicative of output of at least one microphone in response to sound emitted from a set of speakers to be monitored). Typically the sound is generated during playback of an audiovisual program (e.g., a movie trailer) in the presence of an audience in a room (e.g., a movie theater) by the speakers to be monitored. The processor is programmed (with appropriate software) to generate (by performing an embodiment of the inventive method) output data in response to the input audio data, such that the output data are indicative of status of the speakers.

Notation and Nomenclature

Throughout this disclosure, including in the claims, the expression performing an operation "on" signals or data (e.g., filtering, scaling, or transforming the signals or data) is used in a broad sense to denote performing the operation directly on the signals or data, or on processed versions of the signals or data (e.g., on versions of the signals that have undergone preliminary filtering prior to performance of the operation thereon).

Throughout this disclosure including in the claims, the expression "system" is used in a broad sense to denote a device, system, or subsystem. For example, a subsystem that implements a decoder may be referred to as a decoder system, and a system including such a subsystem (e.g., a system that generates X output signals in response to multiple inputs, in which the subsystem generates M of the inputs and the other X-M inputs are received from an external source) may also be referred to as a decoder system.

Throughout this disclosure including in the claims, the following expressions have the following definitions:

speaker and loudspeaker are used synonymously to denote any sound-emitting transducer. This definition includes loudspeakers implemented as multiple transducers (e.g., woofer and tweeter);

speaker feed: an audio signal to be applied directly to a loudspeaker, or an audio signal that is to be applied to an amplifier and loudspeaker in series;

channel (or "audio channel"): a monophonic audio signal;

speaker channel (or "speaker-feed channel"): an audio channel that is associated with a named loudspeaker (at a desired or nominal position), or with a named speaker zone within a defined speaker configuration. A speaker channel is rendered in such a way as to be equivalent to application of the audio signal directly to the named loudspeaker (at the desired or nominal position) or to a speaker in the named speaker zone. The desired position can be static, as is typically the case with physical loudspeakers, or dynamic;

object channel: an audio channel indicative of sound emitted by an audio source (sometimes referred to as an audio "object"). Typically, an object channel determines a parametric audio source description. The source description may determine sound emitted by the source (as a function of time), the apparent position (e.g., 3D spatial coordinates) of the source as a function of time, and optionally also other at least one additional parameter (e.g., apparent source size or width) characterizing the source;

audio program: a set of one or more audio channels and optionally also associated metadata that describes a desired spatial audio presentation;

render: the process of converting an audio program into one or more speaker feeds, or the process of converting an audio program into one or more speaker feeds and converting the speaker feed(s) to sound using one or more loudspeakers (in the latter case, the rendering is sometimes referred to herein as rendering "by" the loudspeaker(s)). An audio channel can be trivially rendered ("at" a desired position) by applying the signal directly to a physical loudspeaker at the desired position, or one or more audio channels can be rendered using one of a variety of virtualization (or upmixing) techniques designed to be substantially equivalent (for the listener) to such trivial rendering. In this latter case, each audio channel may be converted to one or more speaker feeds to be applied to loudspeaker(s) in known locations, which are in general (but may not be) different from the desired position, such that sound emitted by the loudspeaker(s) in response to the feed(s) will be perceived as emitting from the desired position. Examples of such virtualization techniques include binaural rendering via headphones (e.g., using Dolby Headphone processing which simulates up to 7.1 channels of surround sound for the headphone wearer) and wave field synthesis. Examples of such upmixing techniques include ones from Dolby (Prologic type) or others (e.g., Harman Logic 7, Audyssey DSX, DTS Neo, etc.);

azimuth (or azimuthal angle): the angle, in a horizontal plane, of a source relative to a listener/viewer. Typically, an azimuthal angle of 0 degrees denotes that the source is directly in front of the listener/viewer, and the azimuthal angle increases as the source moves in a counter clockwise direction around the listener/viewer;

elevation (or elevational angle): the angle, in a vertical plane, of a source relative to a listener/viewer. Typically, an elevational angle of 0 degrees denotes that the source is in the same horizontal plane as the listener/viewer, and the elevational angle increases as the source moves upward (in a range from 0 to 90 degrees) relative to the viewer;

L: Left front audio channel. A speaker channel, typically intended to be rendered by a speaker positioned at about 30 degrees azimuth, 0 degrees elevation;

C: Center front audio channel. A speaker channel, typically intended to be rendered by a speaker positioned at about 0 degrees azimuth, 0 degrees elevation;

R: Right front audio channel. A speaker channel, typically intended to be rendered by a speaker positioned at about −30 degrees azimuth, 0 degrees elevation;

Ls: Left surround audio channel. A speaker channel, typically intended to be rendered by a speaker positioned at about 110 degrees azimuth, 0 degrees elevation;

Rs: Right surround audio channel. A speaker channel, typically intended to be rendered by a speaker positioned at about −110 degrees azimuth, 0 degrees elevation; and Front Channels: speaker channels (of an audio program) associated with frontal sound stage. Typical front channels are L and R channels of stereo programs, or L, C and R channels of surround sound programs. Furthermore, the fronts could also involve other channels driving more loudspeakers (such as SDDS-type having five front loudspeakers), there could be loudspeakers associated with wide and height channels and surrounds firing as array mode or as discrete individual mode as well as overhead loudspeakers.

DETAILED DESCRIPTION OF EXEMPLARY EMBODIMENTS

Figure 1:
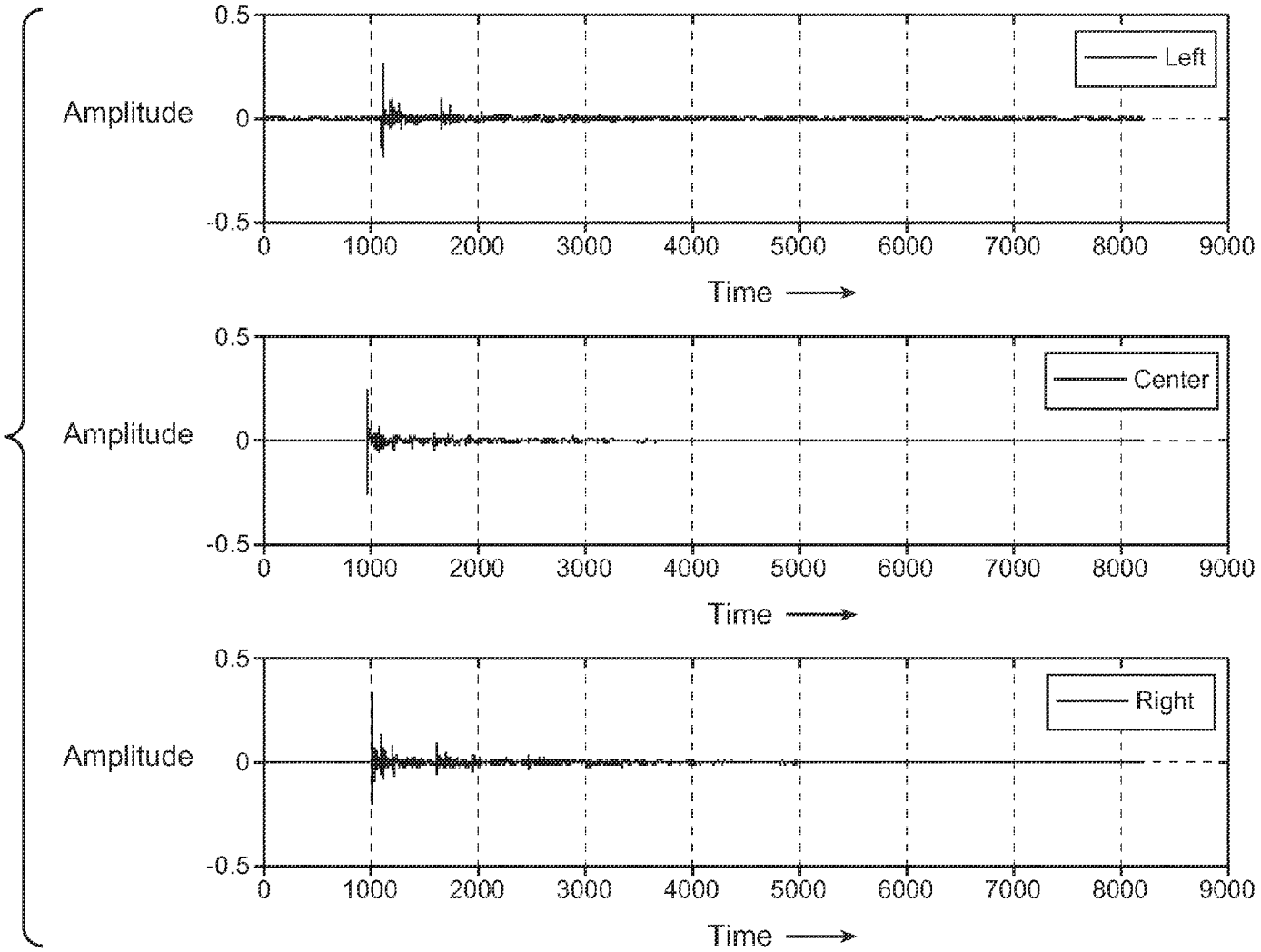
FIG. 1 is a set of three graphs, each of which is the impulse response (magnitude plotted versus time) of a different one of a set of three loudspeakers (a Left channel speaker, a Right channel speaker, and a Center channel speaker) which is monitored in an embodiment of the invention. The impulse response for each speaker is determined in a preliminary operation, before performance of the embodiment of the invention to monitor the speaker, by measuring sound emitted from the speaker with a microphone.

Many embodiments of the present invention are technologically possible. It will be apparent to those of ordinary skill in the art from the present disclosure how to implement them. Embodiments of the inventive system, medium, and method will be described with reference to FIGS. 1-15.

In some embodiments, the invention is a method for monitoring loudspeakers within an audio playback system (e.g., movie theater) environment. In a typical embodiment in this class, the monitoring method assumes that initial characteristics of the speakers (e.g., a room response for each of the speakers) have been determined at an initial time, and relies on one or more microphones positioned (e.g., on a side wall) within the environment to perform a maintenance check (sometimes referred to herein as a quality check or "QC" or status check) on each of the loudspeakers in the environment to identify whether one or more of the following events has occurred since the initial time: (i) at least one individual driver (e.g., woofer, mid-range, or tweeter) in any of the loudspeakers is damaged; (ii) there has been a change in a loudspeaker output spectrum (relative to an output spectrum determined in initial calibration of speakers in the environment); and (iii) there has been a change in polarity of the output of a loudspeaker (relative to a polarity determined in initial calibration of speakers in the environment), e.g., due to replacement of a speaker. The QC check can be performed periodically (e.g., daily).

In a class of embodiments, trailer-based loudspeaker quality checks (QCs) are performed on the individual loudspeakers of a theater's audio playback system during playback of an audiovisual program (e.g., a movie trailer or other entertaining audiovisual program) to an audience (e.g., before a movie is played to the audience). Since it is contemplated that the audiovisual program is typically a movie trailer, it will often be referred to herein as a "trailer." The quality check identifies (for each loudspeaker of the playback system) any difference between a template signal (e.g., a measured initial signal captured by a microphone in response to playback of the trailer's soundtrack by the speaker during a speaker calibration or alignment process), and a measured status signal captured by the microphone in response to playback (by the speakers of the playback system) of the trailer's soundtrack during the quality check. When the trailer includes subject matter which promotes the format of the theater's audiovisual system, a further advantage (to the entity which sells and/or licenses the audiovisual system, as well as to the theater owner) of using such trailer-based loudspeaker QC monitoring is that it incentivizes theater owners to play the trailer to facilitate performance of the quality check while simultaneously providing a significant benefit of promoting (e.g., marketing, and/or increasing audience awareness of) the audiovisual system format.

Typical embodiments of the inventive, trailer-based, loudspeaker quality check method extract individual loudspeaker characteristics from a status signal captured by a microphone during playback of the trailer by all speakers of a playback system during a quality check. Although, in any embodiment of the invention, a microphone set comprising two or more microphones could be used (rather than a single microphone) to capture a status signal during a speaker quality check (e.g., by combining the output of individual microphones in the set to generate the status signal), for simplicity the term "microphone" is used herein (to describe and claim the invention) in a broad sense denoting either an individual microphone or a set of two or more microphones whose outputs are combined to determine a signal to be processed in accordance with an embodiment of the inventive method In typical embodiments, the status signal obtained during the quality check is essentially a linear combination of all the room-response convolved loudspeaker output signals (one for each of the loudspeakers which emits sound during playback of the trailer during the QC) at the microphone. Any failure mode detected by the QC by processing of the status signal is typically conveyed to the theater owner and/or used by a decoder of the theater's audio playback system to change a rendering mode in case of loudspeaker failure.

In some embodiments, the inventive method includes a step of employing a source separation algorithm, a pattern matching algorithm, and/or unique fingerprint extraction from each loudspeaker, to obtain a processed version of the status signal which is indicative of sound emitted from an individual one of the loudspeakers (rather than a linear combination of all the room-response convolved loudspeaker output signals). Typical embodiments, however, implement a cross-correlation/PSD (power spectral density) based approach to monitor status of each individual speaker in the playback environment from a status signal indicative of sound emitted from all the speakers in the environment (without employing a source separation algorithm, a pattern matching algorithm, or unique fingerprint extraction from each speaker).

The inventive method can be performed in home environments as well as in cinema environments, e.g., with the required signal processing of microphone output signals being performed in a home theater device (e.g., an AVR or Blu-ray player that is shipped to the user with the microphone to be employed to perform the method).

Typical embodiments of the invention implement a cross-correlation/power spectral density (PSD) based approach to monitor status of each individual speaker in the playback environment (which is typically a movie theater) from a status signal which is a microphone output signal (sometimes referred to herein as a QC signal) indicative of sound captured during playback (by all the speakers in the environment) of an audiovisual program. The audiovisual program will be referred to below as a trailer, since it is typically a movie trailer. For example, a class of embodiments of the inventive method includes the steps of:

(a) playing back a trailer whose soundtrack has N channels, where N is a positive integer (e.g., an integer greater than one), including by emitting sound, determined by the trailer, from a set of N speakers positioned in the playback environment, with each of the speakers driven by a speaker feed for a different one of the channels of the soundtrack. Typically, the trailer is played back in the presence of an audience in a movie theater;

(b) obtaining audio data indicative of a status signal captured by each microphone of a set of M microphones in the playback environment during play of the trailer in step (a), where M is a positive integer (e.g., M=1 or 2). In typical implementations, the status signal for each microphone is the analog output signal of the microphone in response to play of the trailer during step (a), and the audio data indicative of the status signal are generated by sampling the output signal. Preferably, the audio data are organized into frames having a frame size adequate to obtain sufficient low frequency resolution, and the frame size is preferably sufficient to ensure the presence of content from all channels of the soundtrack in each frame; and (c) processing the audio data to perform a status check on each speaker of the set of N speakers, including by comparing (e.g., identifying whether a significant difference exists between), for each said speaker and each of at least one microphone in the set of M microphones, the status signal captured by the microphone (said status signal being determined by the audio data obtained in step (b)) and a template signal, wherein the template signal is indicative (e.g., representative) of response of a template microphone to playback by the speaker, in the playback environment at an initial time, of a channel of the soundtrack corresponding to said speaker. The template microphone is positioned, at the initial time, at at least substantially the same position in the environment as is a corresponding microphone of the set during step (b). Preferably, the template microphone is the corresponding microphone of the set, and is positioned, at the initial time, at the same position in the environment as is said corresponding microphone during step (b). The initial time is a time before performance of step (b), and the template signal for each speaker is typically predetermined in a preliminary operation (e.g., a preliminary speaker alignment process), or is generated before (or during) step (b) from a predetermined room response for the corresponding speaker-microphone pair and the trailer soundtrack. Alternatively, the template signal (representing the response at a signature microphone or microphones) can be computed in a processor with a-priori knowledge of the loudspeaker-room responses (equalized or unequalized) from the loudspeaker to the corresponding signature microphone(s).

Step (c) preferably includes an operation of determining a cross-correlation (for each speaker and microphone) of the template signal for said speaker and microphone (or a bandpass filtered version of said template signal) with the status signal for said microphone (or a bandpass filtered version thereof), and identifying a difference (if any significant difference exists) between the template signal and the status signal from a frequency domain representation (e.g., power spectrum) of the cross-correlation. In typical embodiments, step (c) includes an operation (for each speaker and microphone) of applying a bandpass filter to the template signal (for the speaker and microphone) and the status signal (for the microphone), and determining (for each microphone) a cross-correlation of each bandpass filtered template signal for the microphone with the bandpass filtered status signal for the microphone, and identifying a difference (if any significant difference exists) between the template signal and the status signal from a frequency domain representation (e.g., power spectrum) of the cross-correlation.

This class of embodiments of the method assumes knowledge of the room responses of the loudspeakers (typically obtained during a preliminary operation, e.g., a speaker alignment or calibration operation) including any equalization or other filters, and knowledge of the trailer soundtrack. In addition knowledge of any other processing related to panning laws and other signals going to the speaker feeds is preferred so as to be modeled in a cinema processor to obtain a template signal at a signature microphone. To determine the template signal employed in step (c) for each speaker-microphone pair, the following steps may be performed. The room response (impulse response) of each speaker is determined (e.g., during a preliminary operation) by measuring sound emitted from the speaker with the microphone positioned in the same environment (e.g., room) as the speaker. Then, each channel signal of the trailer soundtrack is convolved with the corresponding impulse response (the impulse response of the speaker which is driven by the speaker feed for the channel) to determine the template signal (for the microphone) for the channel. The template signal (template) for each speaker-microphone pair is a simulated version of the microphone output signal to be expected at the microphone during performance of the monitoring (quality check) method with the speaker emitting sound determined by the corresponding channel of the trailer soundtrack.

Alternatively, the following steps may be performed to determine each template signal employed in step (c) for each speaker-microphone pair. Each speaker is driven by the speaker feed for the corresponding channel of the trailer soundtrack, and the resulting sound is measured (e.g., during a preliminary operation) with the microphone positioned in the same environment (e.g., room) as the speaker. The microphone output signal for each speaker is the template signal for the speaker (and corresponding microphone), and is a template in the sense that it is the output signal to be expected at the microphone during performance of the monitoring (quality check) method with the speaker emitting sound determined by the corresponding channel of the trailer soundtrack.

For each speaker-microphone pair, any significant difference between the template signal for the speaker (which is either a measured or a simulated template), and a measured status signal captured by the microphone in response to the trailer soundtrack during performance of the inventive monitoring method, is indicative of an unexpected change in the loudspeaker's characteristics.

Figure 3:
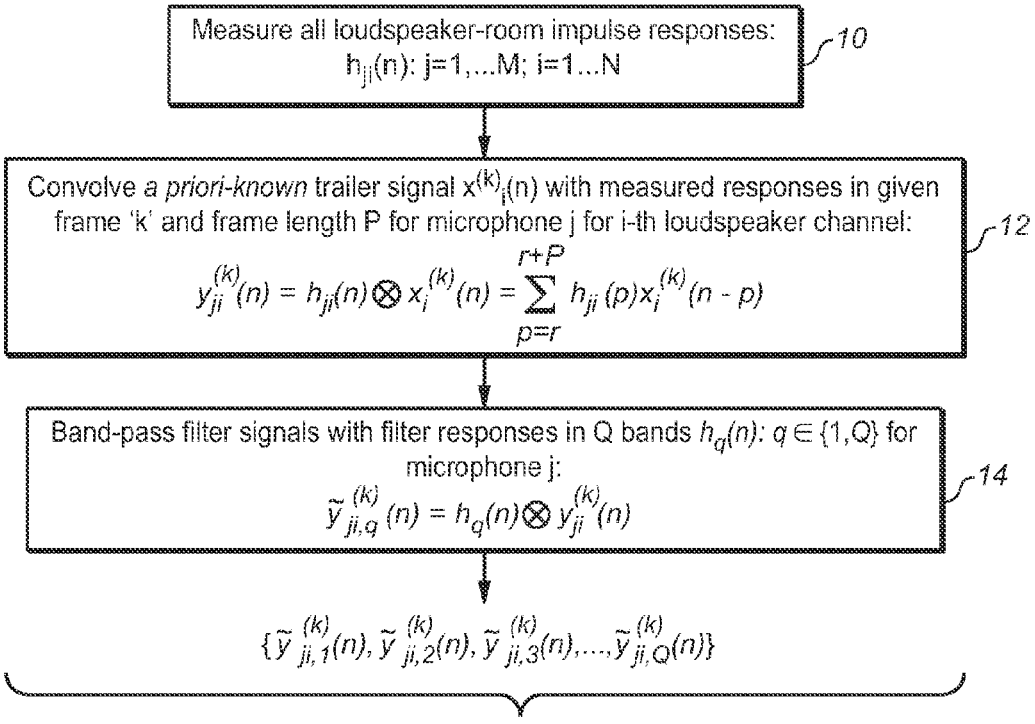
FIG. 3 is a flow chart of steps performed to generate bandpass filtered template signals employed in an embodiment of the invention.
Figure 4:
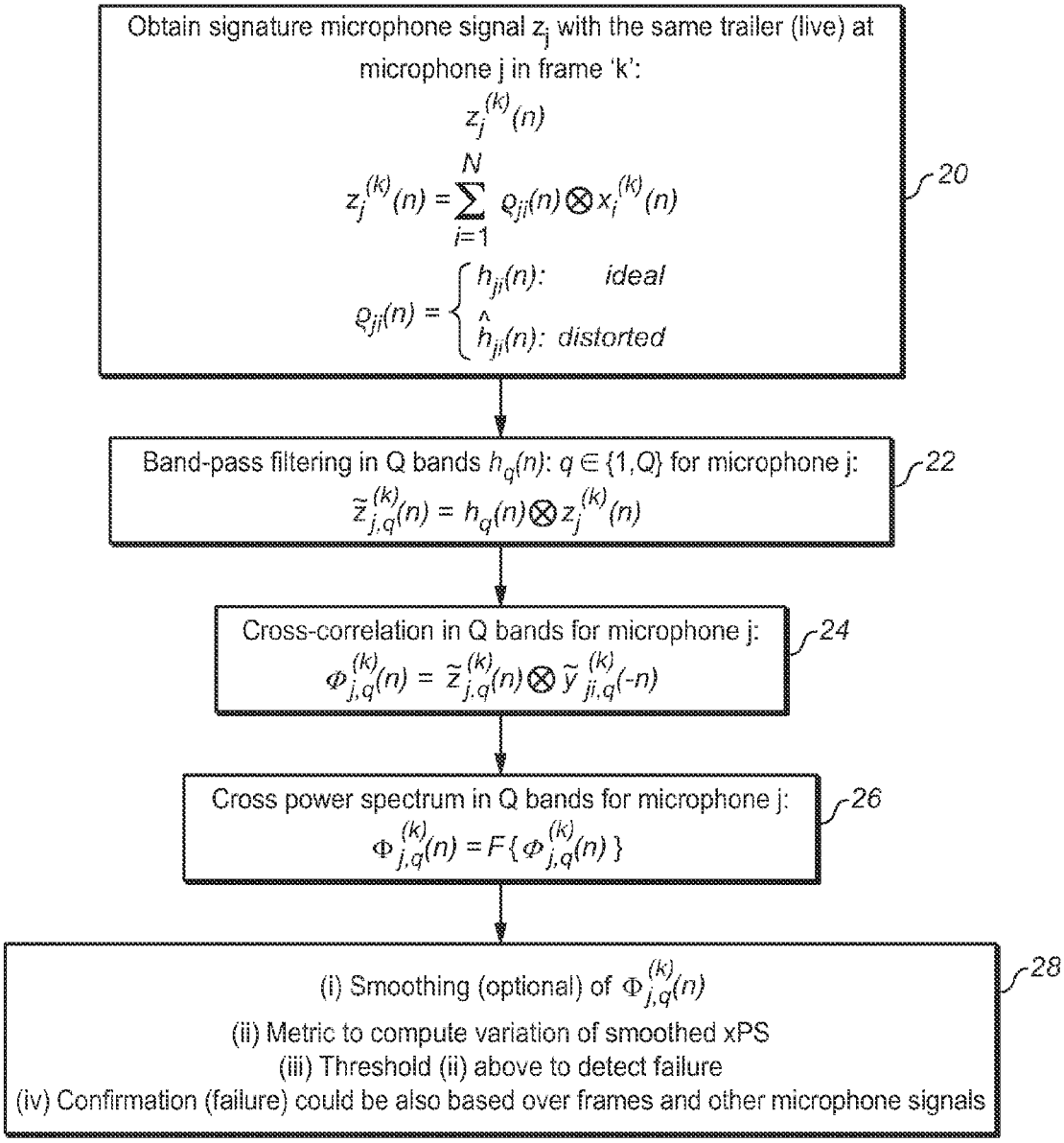
FIG. 4 is a flow chart of steps performed in an embodiment of the invention which determines cross-correlations of bandpass filtered template signals (generated in accordance with FIG. 3) with band-pass filtered microphone output signals.
Figure 5:
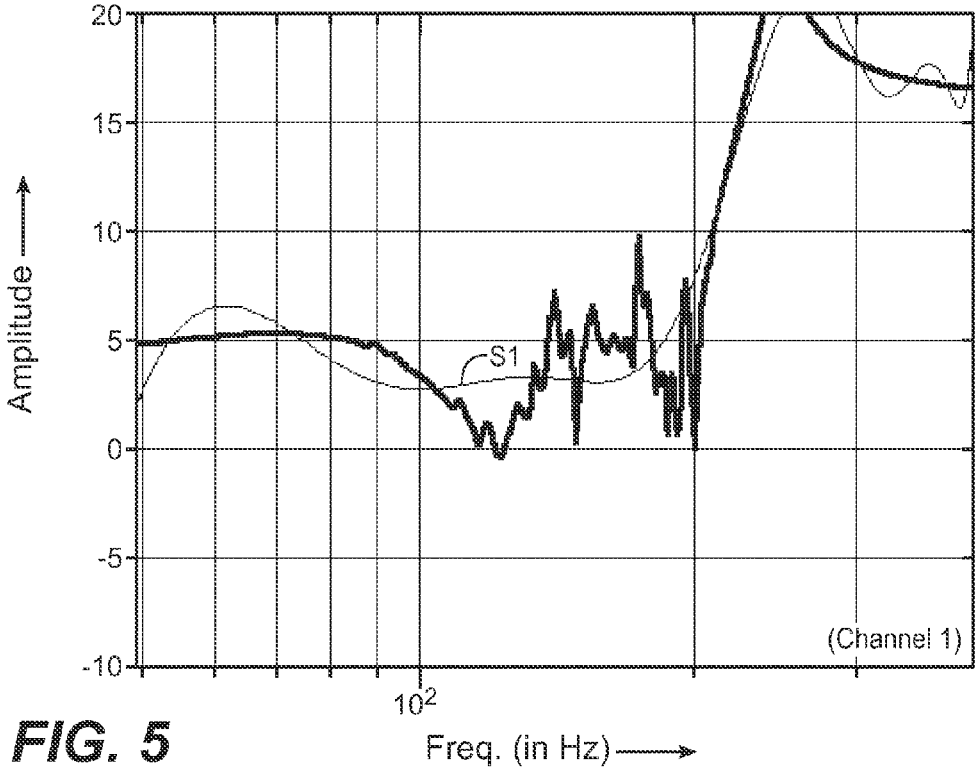
FIG. 5 is a plot of the power spectral density (PSD) of a cross-correlation signal generated by cross-correlating a band-pass filtered template for Channel 1 of a trailer soundtrack (rendered by a Left speaker) with a band-pass filtered microphone output signal measured during playback of the trailer, where each of the template and the microphone output signal has been filtered with a first band-pass filter (whose pass band is 100 Hz-200 Hz).
Figure 6:
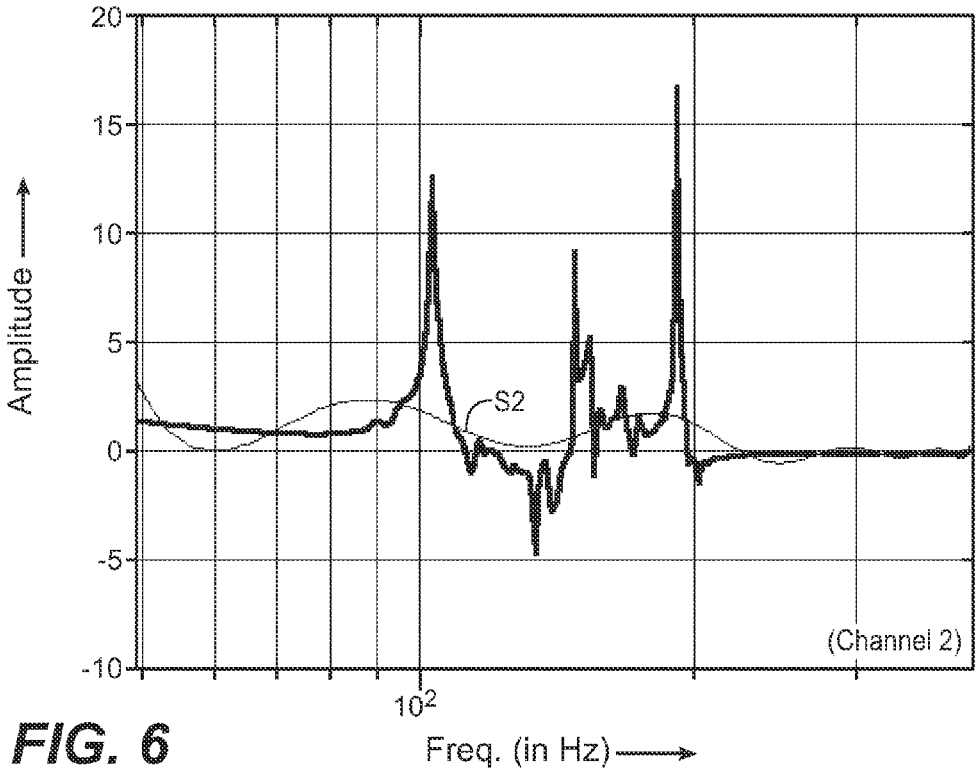
FIG. 6 is a plot of the power spectral density (PSD) of a cross-correlation signal generated by cross-correlating a band-pass filtered template for Channel 2 of a trailer soundtrack (rendered by a Center speaker) with a band-pass filtered microphone output signal measured during playback of the trailer, where each of the template and the microphone output signal has been filtered with the first band-pass filter.
Figure 7:
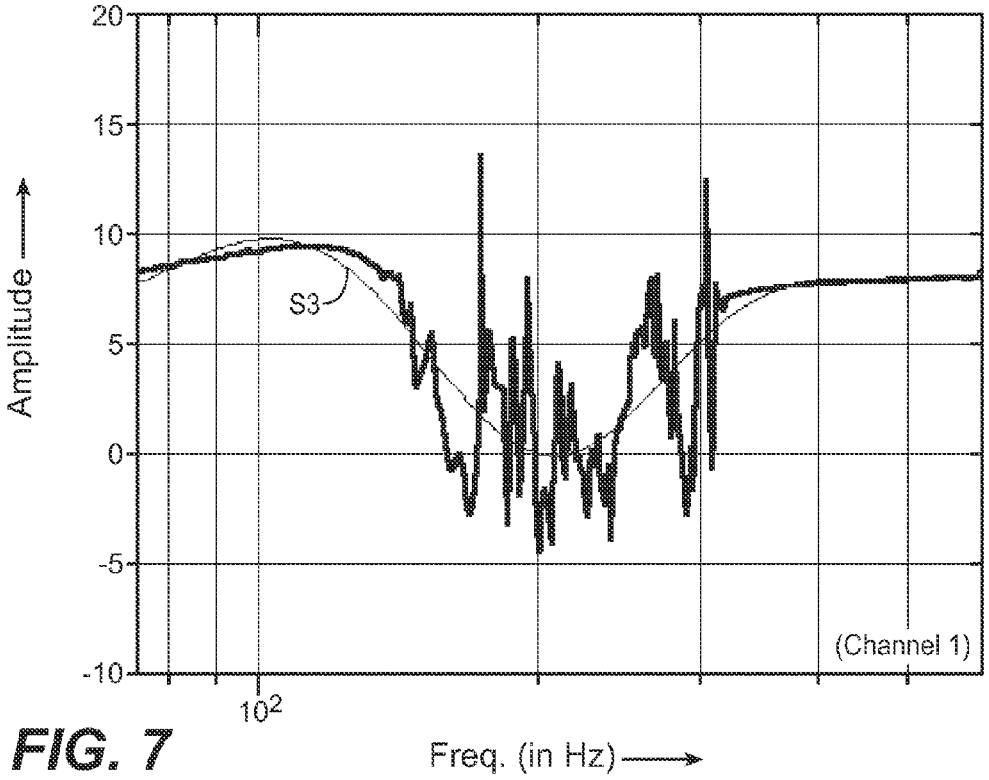
FIG. 7 is a plot of the power spectral density (PSD) of a cross-correlation signal generated by cross-correlating a band-pass filtered template for Channel 1 of a trailer soundtrack (rendered by a Left speaker) with a band-pass filtered microphone output signal measured during playback of the trailer, where each of the template and the microphone output signal has been filtered with a second band-pass filter whose pass band is 150 Hz-300 Hz.
Figure 8:
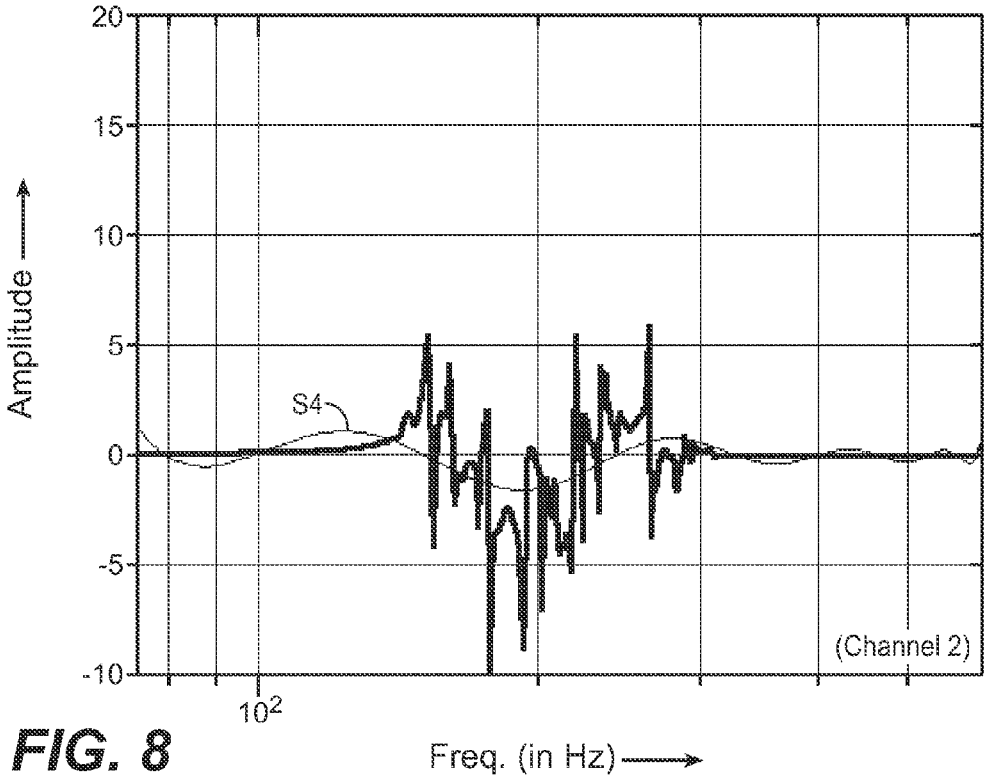
FIG. 8 is a plot of the power spectral density (PSD) of a cross-correlation signal generated by cross-correlating a band-pass filtered template for Channel 2 of a trailer soundtrack (rendered by a Center speaker) with a band-pass filtered microphone output signal measured during playback of the trailer, where each of the template and the microphone output signal has been filtered with the second band-pass filter.
Figure 9:
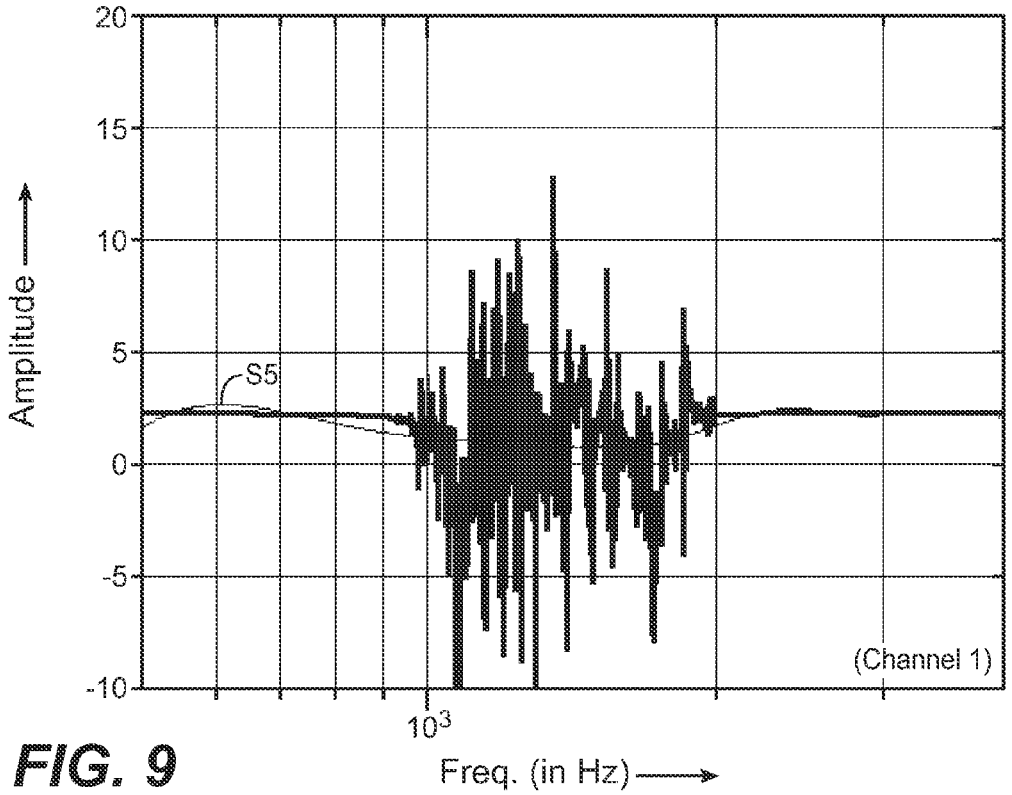
FIG. 9 is a plot of the power spectral density (PSD) of a cross-correlation signal generated by cross-correlating a band-pass filtered template for Channel 1 of a trailer soundtrack (rendered by a Left speaker) with a band-pass filtered microphone output signal measured during playback of the trailer, where each of the template and the microphone output signal has been filtered with a third band-pass filter whose pass band is 1000 Hz-2000 Hz.
Figure 10:
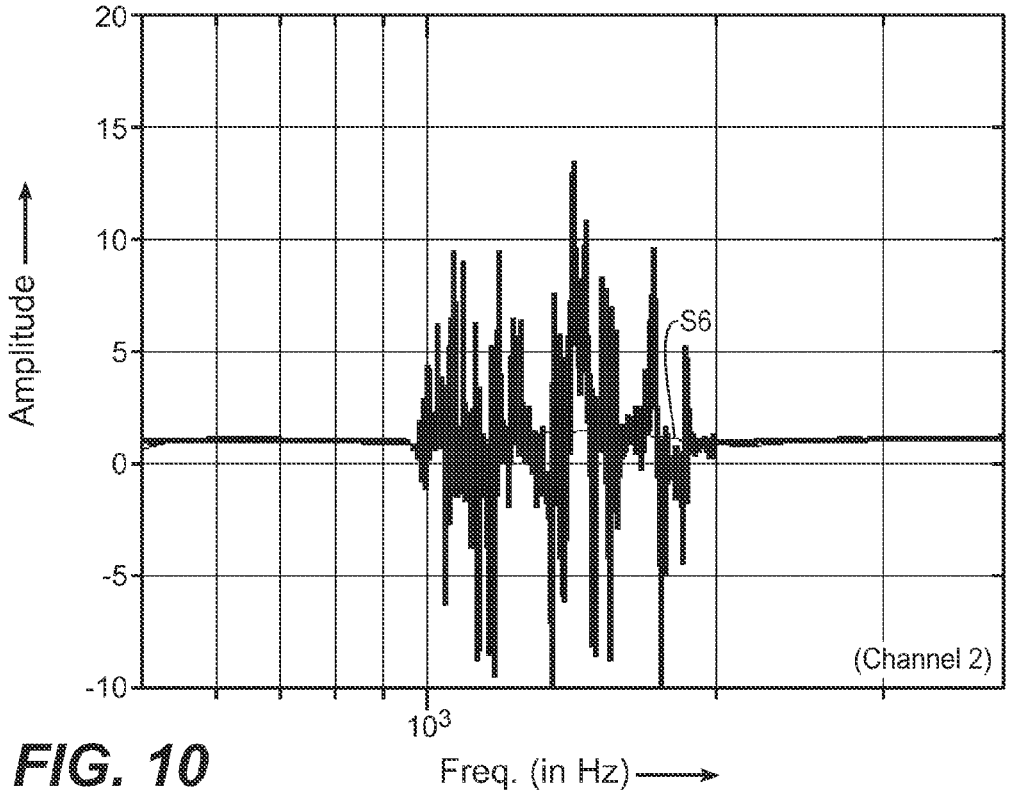
FIG. 10 is a plot of the power spectral density (PSD) of a cross-correlation signal generated by cross-correlating a band-pass filtered template for Channel 2 of a trailer soundtrack (rendered by a Center speaker) with a band-pass filtered microphone output signal measured during playback of the trailer, where each of the template and the microphone output signal has been filtered with the third band-pass filter.
Figure 11:
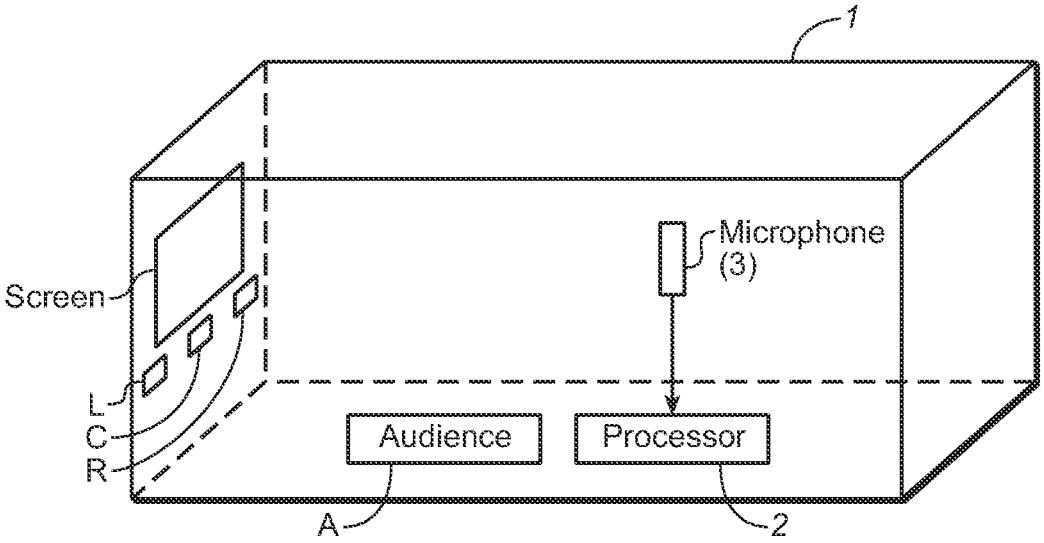
FIG. 11 is a diagram of a playback environment 1 (e.g., a movie theater) in which a Left channel speaker (L), a Center channel speaker (C), and a Right channel speaker (R), and an embodiment of the inventive system are positioned. The embodiment of the inventive system includes microphone 3 and programmed processor 2.

We next describe an exemplary embodiment in more detail with reference to FIGS. 3 and 4. The embodiment assumes that there are N loudspeakers, each of which renders a different channel of the trailer soundtrack, that a set of M microphones is employed to determine the template signal for each speaker-microphone pair, and that the same set of microphones is employed during playback of the trailer in step (a) to generate the status signal for each microphone of the set. The audio data indicative of each status signal are generated by sampling the output signal of the corresponding microphone.

FIG. 3 shows the steps performed to determine the template signals (one for each speaker-microphone pair) that are employed in step (c).

In step 10 of FIG. 3, the room response (impulse response $h_{ji}(n)$) of each speaker-microphone pair is determined (during an operation preliminary to steps (a), (b), and (c)) by measuring sound emitted from the "i"th speaker (where the range of index i is from 1 through N) with the "j"th microphone (where the range of index j is from 1 through M). This step can be implemented in a conventional manner. Exemplary room responses for three speaker-microphone pairs (each determined using the same microphone in response to sound emitted by a different one of three speakers) are shown in FIG. 1, to be described below.

Then, in step 12 of FIG. 3, each channel signal of the trailer soundtrack, $x_i(n)$, where $x^{(k)}_i(n)$ denotes the "k"th frame of the "i"th channel signal, $x_i(n)$, is convolved with each corresponding one of the impulse responses (each impulse response, $h_{ji}(n)$, for the speaker which is driven by the speaker feed for the channel) to determine the template signal $y_{ji}(n)$, for each microphone-speaker pair, where $y^{(k)}_{ji}(n)$ in step 12 of FIG. 3 denotes the "k"th frame of the template signal $y_{ii}(n)$. In this case, the template signal (template) $y_{ji}(n)$, for each speaker-microphone pair is a simulated version of the output signal of the "j"th microphone to be expected during performance of steps (a) and (b) of the inventive monitoring method if the "i"th speaker emits sound determined by the "i"th channel of the trailer soundtrack (and no other speaker emits sound).

Then, in step 14 of FIG. 3, each template signal $y^{(k)}_{ji}(n)$ is band-pass filtered by each of Q different bandpass filters, $h_q(n)$, to generate a bandpass filtered template signal $\tilde{y}_{ji,q}(n)$, whose "k"th frame is $\tilde{y}^{(k)}_{ji,q}(n)$ as shown in FIG. 3, for the "j"th microphone and the "i"th speaker, where the index q is in the range from 1 through Q. Each different filter, $h_q(n)$, has a different pass band.

FIG. 4 shows the steps performed to obtain the audio data in step (b), and operations performed (during step (c)) to implement processing of the audio data.

In step 20 of FIG. 4, for each of the M microphones, a microphone output signal $z_j(n)$, is obtained in response to playback of the trailer soundtrack (the same soundtrack, $x_i(n)$, employed in step 12 of FIG. 3) by all N of the speakers. The "k"th frame of the microphone output signal for the "j"th microphone is $z_j^{(k)}(n)$, as shown in FIG. 4. As indicated by the text of step 20 in FIG. 4, in the ideal case that all the speakers' characteristics during step 20 are identical to the characteristics they had during the preliminary determination of the room responses (in step 10 of FIG. 3), each frame, $z_j^{(k)}(n)$, of the microphone output signal determined in step 20 for the "j"th microphone is identical to the sum (over all speakers) of the following convolutions: the convolution of the predetermined room response for the "i"th speaker and the "j"th microphone ($h_{ji}(n)$), with the "k"th frame, $x^{(k)}_i(n)$, of the "i"th channel of the trailer soundtrack. As also indicated by the text of step 20 in FIG. 4, in the case that the speakers' characteristics during step 20 are not identical to the characteristics they had during the preliminary determination of the room responses (in step 10 of FIG. 3), the microphone output signal determined in step 20 for the "j"th microphone will not be identical to ideal microphone output signal described in the previous sentence, and will instead be indicative of the sum (over all speakers) of the following convolutions: the convolution of a current (e.g. changed) room response for the "i"th speaker and the "j"th microphone $\hat{h}_{ji}(n)$), with the "k"th frame, $x^{(k)}_i(n)$, of the "i"th channel of the trailer soundtrack. The microphone output signal $z_j(n)$ is an example of the inventive status signal referred to in this disclosure.

Then, in step 22 of FIG. 4, each frame, $z_j^{(k)}(n)$, of the microphone output signal determined in step 20 is band-pass filtered by each of the Q different bandpass filters, $h_q(n)$, that were also employed in step 12, to generate a bandpass filtered microphone output signal $\check{z}_{jq}(n)$, whose "k"th frame is $\check{z}^{(k)}_{jq}(n)$ as shown in FIG. 3, for the "j"th microphone, where the index q is in the range from 1 through Q.

Then, in step 24 of FIG. 4, for each speaker (i.e., each channel), each pass band, and each microphone, each frame, $\check{z}^{(k)}_{jq}(n)$, of the bandpass filtered microphone output signal determined in step 20 for the microphone, is cross-correlated with the corresponding frame, $\tilde{y}^{(k)}_{ji,q}(n)$, of the bandpass filtered template signal, $\tilde{y}^{(k)}_{ji,q}(n)$, determined in step 14 of FIG. 3 for the same speaker, microphone, and pass band, to determine cross-correlation signal $\phi^{(k)}_{ji,q}(n)$, for the "i"th speaker, the "q"th pass band, and the "j"th microphone.

Then, in step 26 of FIG. 4, each cross-correlation signal $\phi^{(k)}_{ji,q}(n)$, determined in step 24 undergoes a time-to-frequency domain transform (e.g., a Fourier transform) to determine a cross-correlation power spectrum $\Phi^{(k)}_{ji,q}(n)$ for the "i"th speaker, the "q"th pass band, and the "j"th microphone. Each cross-correlation power spectrum $\Phi^{(k)}_{ji,q}(n)$ (sometimes referred to herein as a cross-correlation PSD) is a frequency domain representation of a corresponding cross-correlation signal $\phi^{(k)}_{ji,q}(n)$. Examples of such cross-correlation power spectra (and smoothed versions thereof) are plotted in FIGS. 5-10, to be discussed below.

In step 28, each cross-correlation PSD determined in step 26 is analyzed (e.g., plotted and analyzed) to determine any significant change (in the relevant frequency pass band) in at least one characteristic of any of the speakers (i.e., in any of the room responses that were preliminarily determined in step 10 of FIG. 3) that is apparent from the cross-correlation PSD. Step 28 can include plotting of each cross-correlation PSD for subsequent visual confirmation. Step 28 can include smoothing of the cross-correlation power spectra, determining a metric to compute variation of the smoothed spectra, and determining whether the metric exceeds a threshold value for each of the smoothed spectra. Confirmation of a significant change in a speaker characteristic (e.g., confirmation of speaker failure) could be based over frames and other microphone signals.

An exemplary embodiment of the method described with reference to FIGS. 3 and 4 will next be described with reference to FIGS. 5-11. This exemplary method is performed in a movie theater (room 1 shown in FIG. 11). On the front wall of room 1, a display screen and three front channel speakers are mounted. The speakers are a left channel speaker (the "L" speaker of FIG. 11) which emits sound indicative of the left channel of a movie trailer soundtrack during performance of the method, a center channel speaker (the "C" speaker of FIG. 11) which emits sound indicative of the center channel of the soundtrack during performance of the method, and a right channel speaker (the "R" speaker of FIG. 11) which emits sound indicative of the center channel of the soundtrack during performance of the method. The output of microphone 3 (mounted on a side wall of room 1) is processed (by appropriately programmed processor 2) in accordance with the inventive method to monitor the status of the speakers.

The exemplary method includes the steps of:

(a) playing back a trailer whose soundtrack has three channels (L, C, and R), including by emitting sound determined by the trailer from the left channel speaker (the L speaker), the center channel speaker (the C speaker), and the right channel speaker (the R speaker), where each of the speakers is positioned in the movie theater, and the trailer is played back in the presence of an audience (identified as audience A in FIG. 11) in the movie theater;

(b) obtaining audio data indicative of a status signal captured by the microphone in the movie theater during playback of the trailer in step (a). The status signal is the analog output signal of the microphone during step (a), and the audio data indicative of the status signal are generated by sampling the output signal. The audio data are organized into frames having a frame size (e.g., a frame size of 16K, i.e., $16{,}384=(128)^2$ samples per frame) adequate to obtain sufficient low frequency resolution, and sufficient to ensure the presence of content from all three channels of the soundtrack in each frame; and (c) processing the audio data to perform a status check on the L speaker, the C speaker, and the R speaker, including by identifying for each said speaker, a difference (if any significant difference exists) between: a template signal indicative of response of the microphone (the same microphone used in step (b), positioned at the same position as is the microphone in step (b), to play of a corresponding channel of the trailer's soundtrack by the speaker at an initial time, and the status signal determined by the audio data obtained in step (b). The "initial time" is a time before performance of step (b), and the template signal for each speaker is determined from a predetermined room response for each speaker-microphone pair and the trailer soundtrack.

In the exemplary embodiment, step (c) includes an operation of determining (for each speaker) a cross-correlation of a first bandpass filtered version of the template signal for said speaker with a first bandpass filtered version of the status signal, a cross-correlation of a second bandpass filtered version of the template signal for said speaker with a second bandpass filtered version of the status signal, and a cross-correlation of a third bandpass filtered version of the template signal for said speaker with a third bandpass filtered version of the status signal. A difference is identified (if any significant difference exists) between the state of each speaker (during performance of step (b)) and the speaker's state at the initial time, from a frequency domain representation of each of the nine cross-correlations. Alternatively, such difference (if any significant difference exists) is identified by otherwise analyzing the cross-correlations.

A damaged low-frequency driver of the L speaker (to be referred to sometimes as the "Channel 1" speaker) is simulated by applying an elliptic high pass filter (HPF), having cutoff frequency of fc=600 Hz and stop-band attenuation of 100 dB, to the speaker feed for the Channel 1 speaker during playback of the trailer during step (a). The speaker feeds for other two channels of the trailer soundtrack are not filtered by the elliptic HPF. This simulates damage only to the low-frequency driver of the Channel 1 speaker. The state of the C speaker (to be referred to sometimes as the "Channel 2" speaker) is assumed to be identical to its state at the initial time, and the state of the R speaker (to be referred to sometimes as the "Channel 3" speaker) is assumed to be identical to its state at the initial time.

The first bandpass filtered version of the template signal for each speaker is generated by filtering the template signal with a first bandpass filter, the first bandpass filtered version of the status signal is generated by filtering the status signal with the first bandpass filter, the second bandpass filtered version of the template signal for each speaker is generated by filtering the template signal with a second bandpass filter, the second bandpass filtered version of the status signal is generated by filtering the status signal with the second bandpass filter, the third bandpass filtered version of the template signal for each speaker is generated by filtering the template signal with a third bandpass filter, and the third bandpass filtered version of the status signal is generated by filtering the status signal with the third bandpass filter.

Each of the band pass filters has linear-phase and length sufficient for adequate transition band rolloff and good stop-band attenuation in its pass band, so that three octave bands of the audio data can be analyzed: a first band between 100-200 Hz (the pass band of the first bandpass filter), a second band between 150-300 Hz (the pass band of the second bandpass filter), and third band between 1-2 kHz (the pass band of the third bandpass filter). The first bandpass filter and the second bandpass filter are linear-phase filters with a group delay of 2K samples. The third bandpass filter has a 512 sample group delay. These filters can be arbitrarily linear-phase, non-linear phase, or quasi-linear phase in the pass-band.

The audio data obtained during step (b) are obtained as follows. Rather, than actually measuring sound emitted from the speakers with the microphone, measurement of such sound is simulated by convolving predetermined room responses for each speaker-microphone pair with the trailer soundtrack (with the speaker feed for Channel 1 of the trailer soundtrack distorted with the elliptic HPF).

FIG. 1 shows the predetermined room responses. The top graph of FIG. 1 is a plot of the impulse response (magnitude plotted versus time) of the Left channel (L) speaker, determined from sound emitted from the L speaker and measured by microphone 3 of FIG. 11 in room 1. The middle graph of FIG. 1 is a plot of the impulse response (magnitude plotted versus time) of the Center channel (C) speaker, determined from sound emitted from the C speaker and measured by microphone 3 of FIG. 11 in room 1. The bottom graph of FIG. 1 is a plot of the impulse response (magnitude plotted versus time) of the Right channel (R) speaker, determined from sound emitted from the R speaker and measured by microphone 3 of FIG. 11 in room 1. The impulse response (room response) for each speaker-microphone pair is determined in a preliminary operation, before performance of steps (a) and (b) to monitor the speakers' status.

Figure 2:
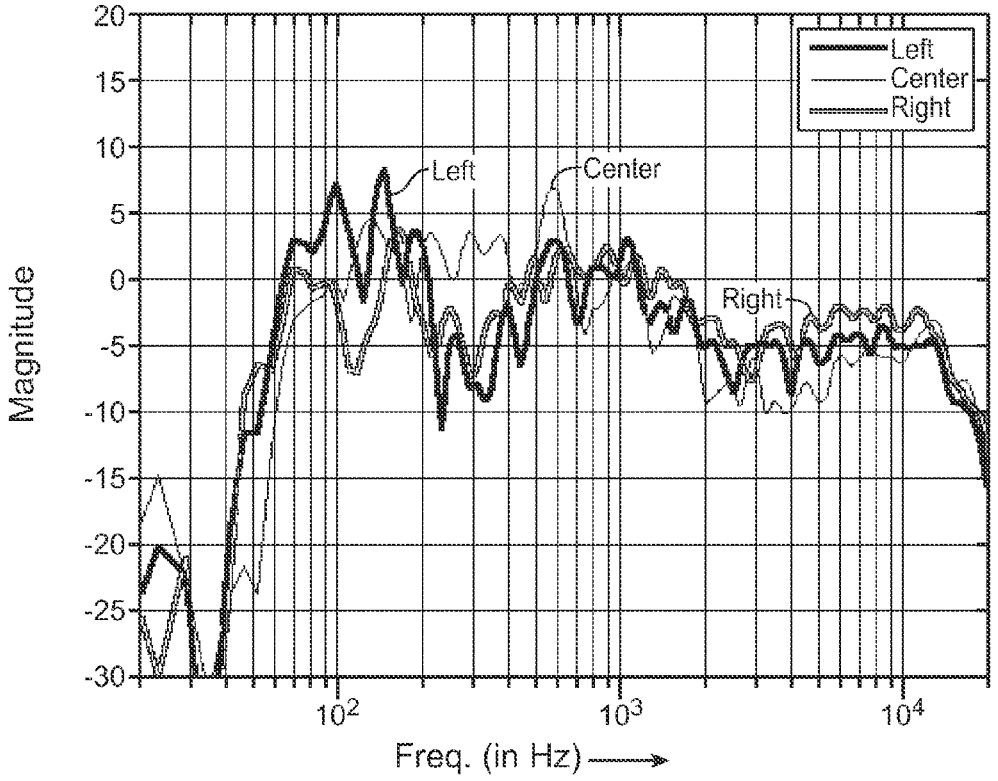
FIG. 2 is a graph of the frequency responses (each a plot of magnitude versus frequency) of the impulse responses of FIG. 1.

FIG. 2 is a graph of the frequency responses (each a plot of magnitude versus frequency) of the impulse responses of FIG. 1. To generate each of the frequency responses, the corresponding impulse response is Fourier transformed.

More specifically, the audio data obtained during step (b) of the exemplary embodiment, are generated as follows. The HPF filtered Channel 1 signal generated in step (a) is convolved with the room response of the Channel 1 speaker to determine a convolution indicative of the damaged Channel 1 speaker output that would be measured by microphone 3 during playback by the damaged Channel 1 speaker of Channel 1 of the trailer. The (nonfiltered) speaker feed for Channel 2 of the trailer soundtrack is convolved with the room response of the Channel 2 speaker to determine a convolution indicative of the Channel 2 speaker output that would measured by microphone 3 during playback by the Channel 2 speaker of Channel 2 of the trailer, and the (nonfiltered) speaker feed for Channel 3 of the trailer soundtrack is convolved with the room response of the Channel 3 speaker to determine a convolution indicative of the Channel 3 speaker output that would measured by microphone 3 during playback by the Channel 3 speaker of Channel 3 of the trailer. The three resulting convolutions are summed to generate audio data indicative of a status signal which simulates the expected output of microphone 3 during playback by all three speakers (with the Channel 1 speaker having a damaged low-frequency driver) of the trailer.

Each of the above-described band-pass filters (one having a pass band between 100-200 Hz, the second having a pass band between 150-300 Hz, and third having a pass band between 1-2 kHz) is applied to the audio data generated in step (b), to determine the above-mentioned first bandpass filtered version of the status signal, second bandpass filtered version of the status signal, and third bandpass filtered version of the status signal.

The template signal for the L speaker is determined by convolving the predetermined room response for the L speaker (and microphone 3) with the left channel (channel 1) of the trailer soundtrack. The template signal for the C speaker is determined by convolving the predetermined room response for the C speaker (and microphone 3) with the center channel (channel 2) of the trailer soundtrack. The template signal for the R speaker is determined by convolving the predetermined room response for the R speaker (and microphone 3) with the right channel (channel 3) of the trailer soundtrack.

In the exemplary embodiment, the following correlation analysis is performed in step (c) on the following signals:

the cross-correlation of the first bandpass filtered version of the template signal for the Channel 1 speaker with the first bandpass filtered version of the status signal. This cross-correlation undergoes a Fourier transform to determine a cross-correlation power spectrum for the 100-200 Hz band of the Channel 1 speaker (of the type generated in step 26 of above-described FIG. 4). This cross-correlation power spectrum, and smoothed version S1 of the power spectrum, are plotted in FIG. 5. The smoothing performed to generate the plotted smoothed version was accomplished by fitting a simple fourth-order polynomial to the cross-correlation power spectrum (but any of a variety of other smoothing methods is employed in variations on the described exemplary embodiment). The cross-correlation power spectrum (or a smoothed version of it) is analyzed (e.g., plotted and analyzed) in a manner to be described below;

the cross-correlation of the second bandpass filtered version of the template signal for the Channel 1 speaker with the second bandpass filtered version of the status signal. This cross-correlation undergoes a Fourier transform to determine a cross-correlation power spectrum for the 150-300 Hz band of the Channel 1 speaker. This cross-correlation power spectrum, and smoothed version S3 of the power spectrum, are plotted in FIG. 7. The smoothing performed to generate the plotted smoothed version was accomplished by fitting a simple fourth-order polynomial to the cross-correlation power spectrum (but any of a variety of other smoothing methods is employed in variations on the described exemplary embodiment). The cross-correlation power spectrum (or a smoothed version of it) is analyzed (e.g., plotted and analyzed) in a manner to be described below;

the cross-correlation of the third bandpass filtered version of the template signal for the Channel 1 speaker with the third bandpass filtered version of the status signal. This cross-correlation undergoes a Fourier transform to determine a cross-correlation power spectrum for the 1000-2000 Hz band of the Channel 1 speaker. This cross-correlation power spectrum, and smoothed version S5 of the power spectrum, are plotted in FIG. 9. The smoothing performed to generate the plotted smoothed version was accomplished by fitting a simple fourth-order polynomial to the cross-correlation power spectrum (but any of a variety of other smoothing methods is employed in variations on the described exemplary embodiment). The cross-correlation power spectrum (or a smoothed version of it) is analyzed (e.g., plotted and analyzed) in a manner to be described below;

the cross-correlation of the first bandpass filtered version of the template signal for the Channel 2 speaker with the first bandpass filtered version of the status signal. This cross-correlation undergoes a Fourier transform to determine a cross-correlation power spectrum for the 100-200 Hz band of the Channel 2 speaker (of the type generated in step 26 of above-described FIG. 4). This cross-correlation power spectrum, and smoothed version S2 of the power spectrum, are plotted in FIG. 6. The smoothing performed to generate the plotted smoothed version was accomplished by fitting a simple fourth-order polynomial to the cross-correlation power spectrum (but any of a variety of other smoothing methods is employed in variations on the described exemplary embodiment). The cross-correlation power spectrum (or a smoothed version of it) is analyzed (e.g., plotted and analyzed) in a manner to be described below;

the cross-correlation of the second bandpass filtered version of the template signal for the Channel 2 speaker with the second bandpass filtered version of the status signal. This cross-correlation undergoes a Fourier transform to determine a cross-correlation power spectrum for the 150-300 Hz band of the Channel 2 speaker. This cross-correlation power spectrum, and smoothed version S4 of the power spectrum, are plotted in FIG. 8. The smoothing performed to generate the plotted smoothed version was accomplished by fitting a simple fourth-order polynomial to the cross-correlation power spectrum (but any of a variety of other smoothing methods is employed in variations on the described exemplary embodiment). The cross-correlation power spectrum (or a smoothed version of it) is analyzed (e.g., plotted and analyzed) in a manner to be described below;

the cross-correlation of the third bandpass filtered version of the template signal for the Channel 2 speaker with the third bandpass filtered version of the status signal. This cross-correlation undergoes a Fourier transform to determine a cross-correlation power spectrum for the 1000-2000 Hz band of the Channel 2 speaker. This cross-correlation power spectrum, and smoothed version S6 of the power spectrum, are plotted in FIG. 10. The smoothing performed to generate the plotted smoothed version was accomplished by fitting a simple fourth-order polynomial to the cross-correlation power spectrum (but any of a variety of other smoothing methods is employed in variations on the described exemplary embodiment). The cross-correlation power spectrum (or a smoothed version of it) is analyzed (e.g., plotted and analyzed) in a manner to be described below;

the cross-correlation of the first bandpass filtered version of the template signal for the Channel 3 speaker with the first bandpass filtered version of the status signal. This cross-correlation undergoes a Fourier transform to determine a cross-correlation power spectrum for the 100-200 Hz band of the Channel 3 speaker (of the type generated in step 26 of above-described FIG. 4). This cross-correlation power spectrum (or a smoothed version of it) is analyzed (e.g., plotted and analyzed) in a manner to be described below. The smoothing performed to generate the smoothed version may be accomplished by fitting a simple fourth-order polynomial to the cross-correlation power spectrum or in any of a variety of other smoothing methods);

the cross-correlation of the second bandpass filtered version of the template signal for the Channel 3 speaker with the second bandpass filtered version of the status signal. This cross-correlation undergoes a Fourier transform to determine a cross-correlation power spectrum for the 150-300 Hz band of the Channel 3 speaker. This cross-correlation power spectrum (or a smoothed version of it) is analyzed (e.g., plotted and analyzed) in a manner to be described below. The smoothing performed to generate the smoothed version may be accomplished by fitting a simple fourth-order polynomial to the cross-correlation power spectrum or in any of a variety of other smoothing methods); and the cross-correlation of the third bandpass filtered version of the template signal for the Channel 3 speaker with the third bandpass filtered version of the status signal. This cross-correlation undergoes a Fourier transform to determine a cross-correlation power spectrum for the 1000-2000 Hz band of the Channel 3 speaker. This cross-correlation power spectrum (or a smoothed version of it) is analyzed (e.g., plotted and analyzed) in a manner to be described below. The smoothing performed to generate the smoothed version may be accomplished by fitting a simple fourth-order polynomial to the cross-correlation power spectrum or in any of a variety of other smoothing methods).

A difference is identified (if any significant difference exists) between the state of each speaker (during performance of step (b)) in each of the three octave-bands, and the speaker's state in each of the three octave-bands at the initial time, from the nine cross-correlation power spectra described above (or a smoothed version of each of them).

More specifically, consider the smoothed versions S1, S2, S3, S4, S5, and S6, of cross-correlation power spectra which are plotted in FIGS. 5-10.

Due to the distortion present in Channel 1 (i.e., the change in status of the Channel 1 speaker, namely the simulated damage to its low frequency driver, during performance of step (b) relative to its status at the initial time), the smoothed cross-correlation power spectra S1, S3, and S5 (of FIGS. 5, 7, and 9, respectively) show a significant deviation from zero amplitude in each frequency band in which distortion exists for this channel (i.e., in each frequency band below 600 Hz). Specifically, smoothed cross-correlation power spectrum S1 (of FIG. 5) shows a significant deviation from zero amplitude in the frequency band (from 100 Hz to 200 Hz) in which this smoothed power spectrum includes useful information, and smoothed cross-correlation power spectrum S3 (of FIG. 7) shows a significant deviation from zero amplitude in the frequency band (from 150 Hz to 300 Hz) in which this smoothed power spectrum includes useful information. However, smoothed cross-correlation power spectrum S5 (of FIG. 9) does not show significant deviation from zero amplitude in the frequency band (from 1000 Hz to 2000 Hz) in which this smoothed power spectrum includes useful information.

Since no distortion is present in Channel 2 (i.e., the Channel 2 speaker's status during performance of step (b) is identical to its status at the initial time), the smoothed cross-correlation power spectra S2, S4, and S6 (of FIGS. 6, 8, and 10, respectively) do not show significant deviation from zero amplitude in any frequency band.

In this context, presence of "significant deviation" from zero amplitude in the relevant frequency band means that the mean or the standard deviation (or each of the mean and the standard deviation) of the amplitude of the relevant smoothed cross-correlation power spectrum is greater than zero (or another metric of the relevant cross-correlation power spectrum differs from zero or another predetermined value) by more than a predetermined threshold for the frequency band. In this context, the difference between the mean (or standard deviation) of the amplitude of the relevant smoothed cross-correlation power spectrum, and a predetermined value (e.g., zero amplitude), is a "metric" of the smoothed cross-correlation power spectrum. Metrics other than standard deviation could be utilized such as spectral deviation, etc. In other embodiments of the invention, some other characteristic of the cross-correlation power spectra obtained in accordance with the invention (or of smoothed versions of them) is employed to assess status of loudspeakers in each frequency band in which the spectra (or smoothed versions of them) include useful information.

Typical embodiments of the invention monitor the transfer function applied by each loudspeaker to the speaker feed for a channel of an audiovisual program (e.g., a movie trailer) as measured by capturing sound emitted from the loudspeaker using a microphone, and flag when changes occur. Since a typical trailer does not cause only one loudspeaker at a time active sufficiently long to make a transfer function measurement, some embodiments of the invention employ cross correlation averaging methods to separate the transfer function of each loudspeaker from that of the other loudspeakers in the playback environment. For example, in one such embodiment the inventive method includes steps of: obtaining audio data indicative of a status signal captured by a microphone (e.g., in a movie theater) during playback of a trailer; and processing the audio data to perform a status check on the speakers employed to play back the trailer, including by, for each of the speakers, comparing (including by implementing cross correlation averaging) a template signal indicative of response of the microphone to play back of a corresponding channel of the trailer's soundtrack by the speaker at an initial time, and the status signal determined by the audio data. The step of comparing typically includes identifying a difference, if any significant difference exists, between the template signal and the status signal. The cross correlation averaging (during the step of processing the audio data) typically includes steps of determining a sequence of cross-correlations (for each speaker) of the template signal for said speaker and the microphone (or a bandpass filtered version of said template signal) with the status signal for said microphone (or a bandpass filtered version of the status signal), where each of the cross-correlations is a cross-correlation of a segment (e.g., a frame or sequence of frames) of the template signal for said speaker and the microphone (or a bandpass filtered version of said segment) with a corresponding segment (e.g., a frame or sequence of frames) of the status signal for said microphone (or a bandpass filtered version of said segment), and identifying a difference (if any significant difference exists) between the template signal and the status signal from an average of the cross-correlations.

Cross correlation averaging can be employed because correlated signals add linearly with the number of averages while uncorrelated ones add as the square root of the number of averages. Thus the signal to noise ratio (SNR) improves as the square root of the number of averages. Situations with a large amount of uncorrelated signals compared to the correlated ones require more averages to get a good SNR. The averaging time can be adjusted by comparing the total level at the microphone to what is predicted from the speaker being assessed.

It has been proposed to employ cross correlation averaging in adaptive equalization processes (e.g., for Bluetooth headsets). However, before the present invention, it had not been proposed to employ correlated averaging to monitor status of individual loudspeakers in an environment in which multiple loudspeakers are emitting sound simultaneously and a transfer function for each loudspeaker needs to be determined. As long as each loudspeaker produces output signals uncorrelated with those produced by the other loudspeakers, correlated averaging can be used to separate the transfer functions. However, since this may not always be the case, the estimated relative signal levels at the microphone and the degree of correlation between the signals at each loudspeaker can be used to control the averaging process.

For example, in some embodiments, during assessment of the transfer function from one of the speakers to a microphone, when a significant amount of correlated signal energy between other speakers and the speaker being assessed for its transfer function is present, the transfer function estimating process is turned off or slowed. For example, if a 0 dB SNR is required, the transfer function estimating process can be turned off for each speaker-microphone combination when the total estimated acoustic energy at the microphone from the correlated components of all other speakers is comparable to the estimated acoustic energy from the speaker whose transfer function is being estimated. The estimated correlated energy at the microphone can be obtained by determining the correlated energy in the signals feeding each speaker, filtered by the appropriate transfer functions from each speaker to each microphone in question, with these transfer functions typically having been obtained during an initial calibration process. Turning off the estimation process can be done on a frequency band by band basis rather than the whole transfer function at a time.

For example, a status check on each speaker of a set of N speakers can include, for each speaker-microphone pair consisting of one of the speakers and one of a set of M microphones, the steps of:

(d) determining cross-correlation power spectra for the speaker-microphone pair, where each of the cross-correlation power spectra is indicative of a cross-correlation of the speaker feed for the speaker of said speaker-microphone pair and the speaker feed for another one of the set of N speakers;

(e) determining an auto-correlation power spectrum indicative of an auto-correlation of the speaker feed for the speaker of said speaker-microphone pair;

(f) filtering each of the cross-correlation power spectra and the auto-correlation power spectrum with a transfer function indicative of a room response for the speaker-microphone pair, thereby determining filtered cross-correlation power spectra and a filtered auto-correlation power spectrum;

(g) comparing the filtered auto-correlation power spectrum to a root mean square sum of all the filtered cross-correlation power spectra; and (h) temporarily halting or slowing down the status check for the speaker of the speaker-microphone pair in response to determining that the root mean square sum is comparable to or greater than the filtered auto-correlation power spectrum.

Step (g) can include a step of comparing the filtered auto-correlation power spectrum and the root mean square sum on a frequency band-by-band basis, and step (h) can include a step of temporarily halting or slowing down the status check for the speaker of the speaker-microphone pair in each frequency band in which the root mean square sum is comparable to or greater than the filtered auto-correlation power spectrum.

In another class of embodiments, the inventive method processes data indicative of the output of at least one microphone to monitor audience reaction (e.g., laughter or applause) to an audiovisual program (e.g., a movie played in a movie theater), and provides the resulting output data (indicative of audience reaction) to interested parties (e.g., studios) as a service (e.g., via a web connected d-cinema server). The output data can inform a studio that a comedy is doing well based on how often and how loud the audience laughs or how a serious film is doing based on whether audience members applaud at the end. The method can provide geographically based feedback (e.g., to studios) which may be used to direct advertising for promotion of a movie.

Typical embodiments in this class implement the following key techniques:

(i) separation of playback content (i.e., audio content of the program played back in the presence of the audience) from audience signals captured by each microphone (during playback of the program in the presence of the audience).

Such separation is typically implemented by a processor coupled to receive the output of each microphone and is achieved by knowing the signal to the speaker feeds, knowing the loudspeaker-room responses to each of the "signature" microphones, and performing temporal or spectral subtraction of the measured signal at the signature microphone from a filtered signal, where the filtered signal is computed in a side-chain in the processor, the filtered signal being obtained by filtering the loudspeaker-room responses with the speaker feed signals. The speaker-feed signals by themselves could be filtered versions of the actual arbitrary movie/advertisement/preview content signals with the associated filtering being done by equalization filters and other processing such as panning; and (ii) content analysis and pattern classification techniques (also typically implemented by a processor coupled to receive the output of each microphone) to discriminate between different audience signals captured by the microphone(s).

For example, an embodiment in this class is a method for monitoring audience reaction to an audiovisual program played back by a playback system including a set of N speakers in a playback environment, where N is a positive integer, wherein the program has a soundtrack comprising N channels. The method includes steps of: (a) playing back the audiovisual program in the presence of an audience in the playback environment, including by emitting sound, determined by the program, from the speakers of the playback system in response to driving each of the speakers with a speaker feed for a different one of the channels of the soundtrack; (b) obtaining audio data indicative of at least one microphone signal generated by at least microphone in the playback environment during emission of the sound in step (a); and (c) processing the audio data to extract audience data from said audio data, and analyzing the audience data to determine audience reaction to the program, wherein the audience data are indicative of audience content indicated by the microphone signal, and the audience content comprises sound produced by the audience during playback of the program.

Separation of playback content from audience content can be achieved by performing a spectral subtraction, where the difference is obtained between the measured signal at each microphone and a sum of filtered versions of the speaker feed signals delivered to the loudspeakers (with the filters being copies of equalized room responses of the speakers measured at the microphone). Thus, a simulated version of the signal expected to be received at the microphone in response to the program alone is subtracted from the actual signal received at the microphone in response to the combined program and audience signal. The filtering can be done with different sampling rates to get better resolution in specific frequency bands.

The pattern recognition can utilize supervised or unsupervised clustering/classification techniques.

Figure 12:
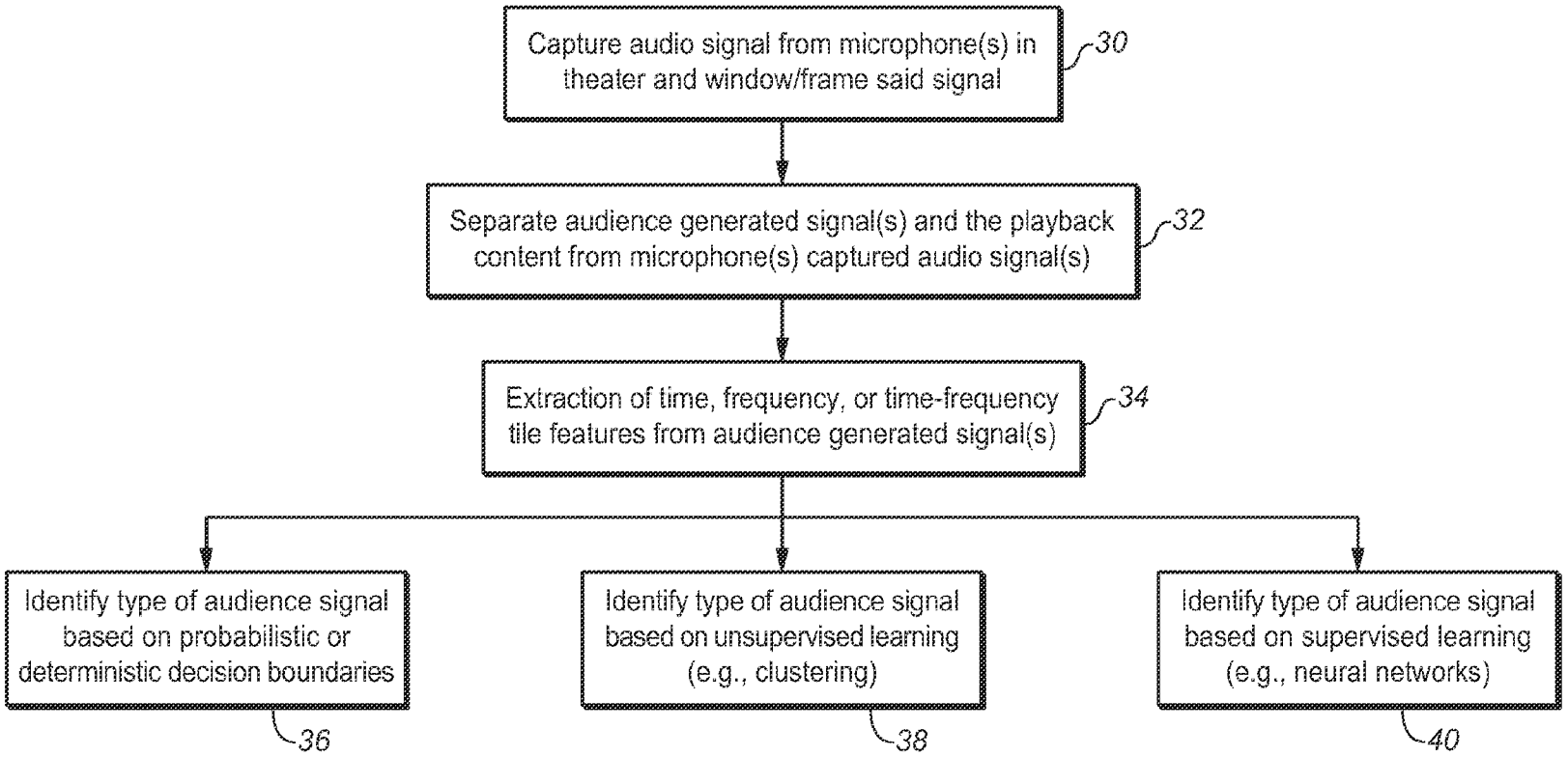
FIG. 12 is a flow chart of steps performed in an embodiment of the invention to identify an audience-generated signal (audience signal) from the output of at least one microphone captured during playback of an audiovisual program (e.g., a movie) in the presence of an audience, including by separating the audience signal from program content of the microphone output.

FIG. 12 is a flow chart of steps performed in an exemplary embodiment of the inventive method for monitoring audience reaction to an audiovisual program (having a soundtrack comprising N channels) during playback of the program by a playback system including a set of N speakers in a playback environment, where N is a positive integer.

With reference to FIG. 12, step 30 of this embodiment includes the steps of playing back the audiovisual program in the presence of an audience in the playback environment, including by emitting sound determined by the program from the speakers of the playback system in response to driving each of the speakers with a speaker feed for a different one of the channels of the soundtrack, and obtaining audio data indicative of at least one microphone signal generated by at least microphone in the playback environment during emission of the sound;

Step 32 determines audience audio data, indicative of sound produced by the audience during step 30 (referred to as an "audience generated signal" or "audience signal" in FIG. 12). The audience audio data is determined from the audio data by removing program content from the audio data.

In step 34, time, frequency, or time-frequency tile features are extracted from the audience audio data.

After step 34, at least one of steps 36, 38, and 40 is performed (e.g., all of steps 36, 38, and 40 are performed).

In step 36, the type of audience audio data (e.g., a characteristic of audience reaction to the program indicated by the audience audio data) is identified from the tile features determined in step 34, based on probabilistic or deterministic decision boundaries.

In step 38, the type of audience audio data (e.g., a characteristic of audience reaction to the program indicated by the audience audio data) is identified from the tile features determined in step 34, based on unsupervised learning (e.g., clustering).

In step 40, the type of audience audio data (e.g., a characteristic of audience reaction to the program indicated by the audience audio data) is identified from the tile features determined in step 34, based on supervised learning (e.g., neural networks).

Figure 13:
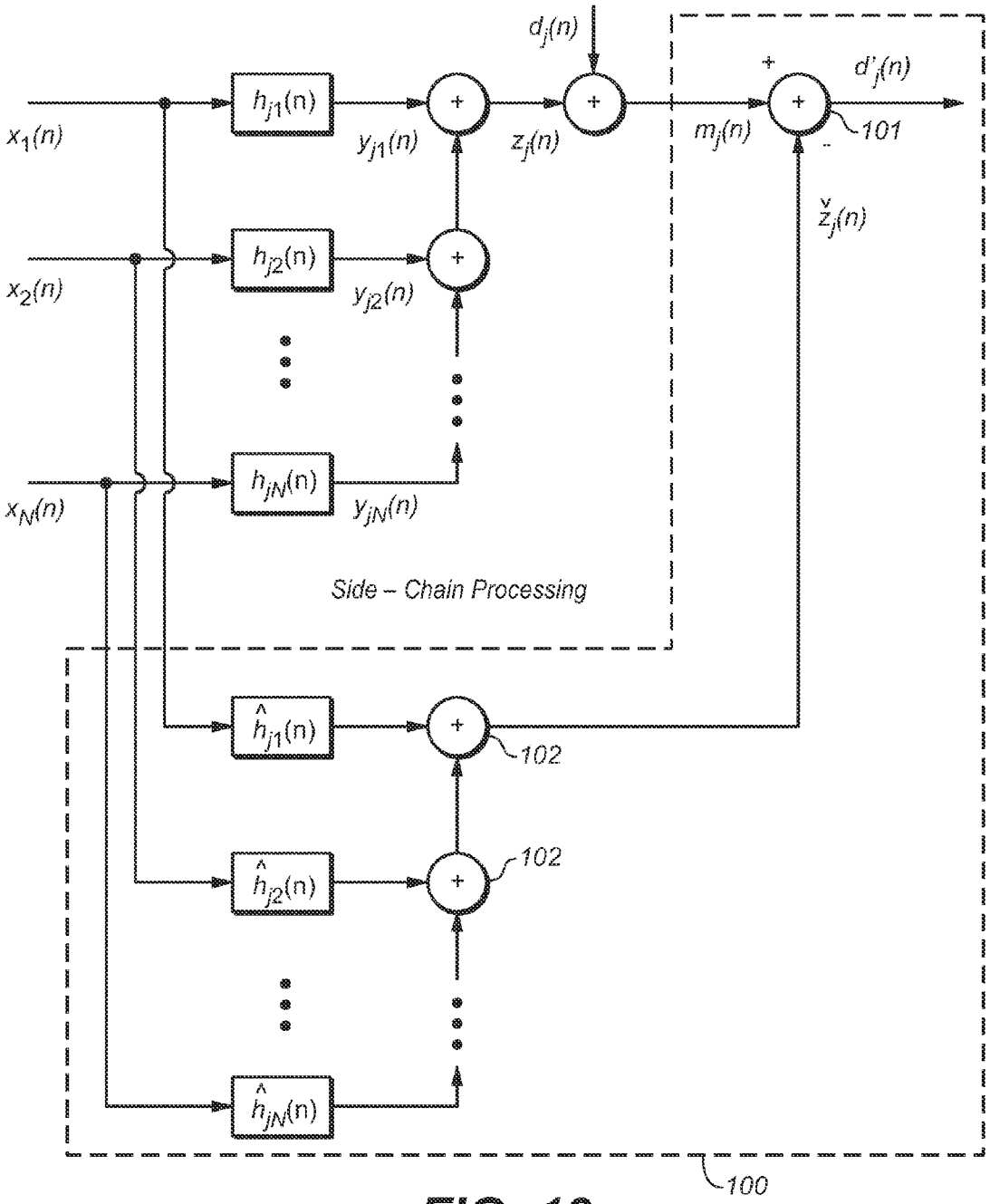
FIG. 13 is a block diagram of a system for processing the output of a microphone ("$m_j(n)$") captured during playback of an audiovisual program (e.g., a movie) in the presence of an audience, to separate an audience-generated signal (audience signal "$d'_j(n)$") from program content of the microphone output.

FIG. 13 is a block diagram of a system for processing the output ("$m_j(n)$") of a microphone (the "j"th microphone of a set of one or more microphones), captured during playback of an audiovisual program (e.g., a movie) having N audio channels in the presence of an audience, to separate audience-generated content indicated by the microphone output (audience signal "$d_j(n)$") from program content indicated by the microphone output. The FIG. 13 system is used to perform one implementation of step 32 of the FIG. 12 method, although other systems could be used to perform other implementations of step 32.

The FIG. 13 system includes a processing block 100 configured to generate each sample, $d'_j(n)$, of the audience-generated signal from a corresponding sample, $m_j(n)$, of the microphone output, where sample index n denotes time. More specifically, block 100 includes subtraction element 101, which is coupled and configured to subtract an estimated program content sample, $\check{z}_j(n)$, from a corresponding sample, $m_j(n)$, of the microphone output, where sample index n again denotes time, thereby generating a sample, $d_j(n)$, of the audience-generated signal.

As indicated in FIG. 13, each sample, $m_j(n)$, of the microphone output (at the time corresponding to the value of index n), can be thought of as the sum of samples of the sound emitted (at the time corresponding to the value of index n) by N speakers (employed to render the program's soundtrack) in response to the N audio channels of the program, as captured by the "j"th microphone, summed with a sample, $d_j(n)$ (at the time corresponding to the same value of index n) of audience-generated sound produced by the audience during playback of the program. As also indicated in FIG. 13, the output signal, $y_{ji}(n)$, of the "i"th speaker as captured by the "j"th microphone is equivalent to convolution of the corresponding channel of the program soundtrack, $x_i(n)$, with the room response (impulse response $h_{ji}(n)$) for the relevant microphone-speaker pair.

The other elements of block 100 of FIG. 13 generate the estimated program content samples, $\check{z}_j(n)$, in response to the channels, $x_i(n)$, of the program soundtrack. In the element labeled $\hat{h}_{j1}(n)$, the first channel ($x_1(n)$) of the soundtrack is convolved with an estimated room response (impulse response $\hat{h}_{j1}(n)$) for the first speaker (i=1) and the "j"th microphone. In each other element labeled $\hat{h}_{ji}(n)$, the "i"th channel ($x_i(n)$) of the soundtrack is convolved with an estimated room response (impulse response $\hat{h}_{ji}(n)$) for the "i"th speaker (where i ranges from 2 to N) and the "j"th microphone.

The estimated room responses, $\hat{h}_{ji}(n)$ for the "j"th microphone can be determined (e.g., during a preliminary operation with no audience present) by measuring sound emitted from the speakers with the microphone positioned in the same environment (e.g., room) as the speakers. The preliminary operation may be an initial alignment process in which the speakers of the audio playback system are initially calibrated. Each such response is an "estimated" response in the sense that it is expected to be similar to the room response (for the relevant microphone-speaker pair) actually existing during performance of the inventive method to determine monitoring audience reaction to an audiovisual program, although it may differ from the room response (for the microphone-speaker pair) actually existing during performance of the inventive method due (e.g., due to changes over time to the state of one or more of the microphone, the speaker, and the playback environment, that may have occurred since performance of the preliminary operation).

Alternatively, the estimated room responses, $\hat{h}_{ji}(n)$, for the "j"th microphone, can be determined by adaptively updating an initially determined set of estimated room responses (e.g., where the initially determined estimated room responses are determined during a preliminary operation with no audience present). The initially determined set of estimated room responses may be determined in an initial alignment process in which the speakers of the audio playback system are initially calibrated.

For each value of index n, the output signals of all the $\hat{h}_{ji}(n)$ elements of block 100 are summed (in addition elements 102) to generate the estimated program content sample, $\check{z}_j(n)$, for said value of index n. The current estimated program content sample, $\check{z}_j(n)$, is asserted to subtraction element 101 in which it is subtracted from a corresponding sample, $m_j(n)$, of the microphone output obtained during playback of the program in the presence of the audience whose reactions are to be monitored.

Figure 14:
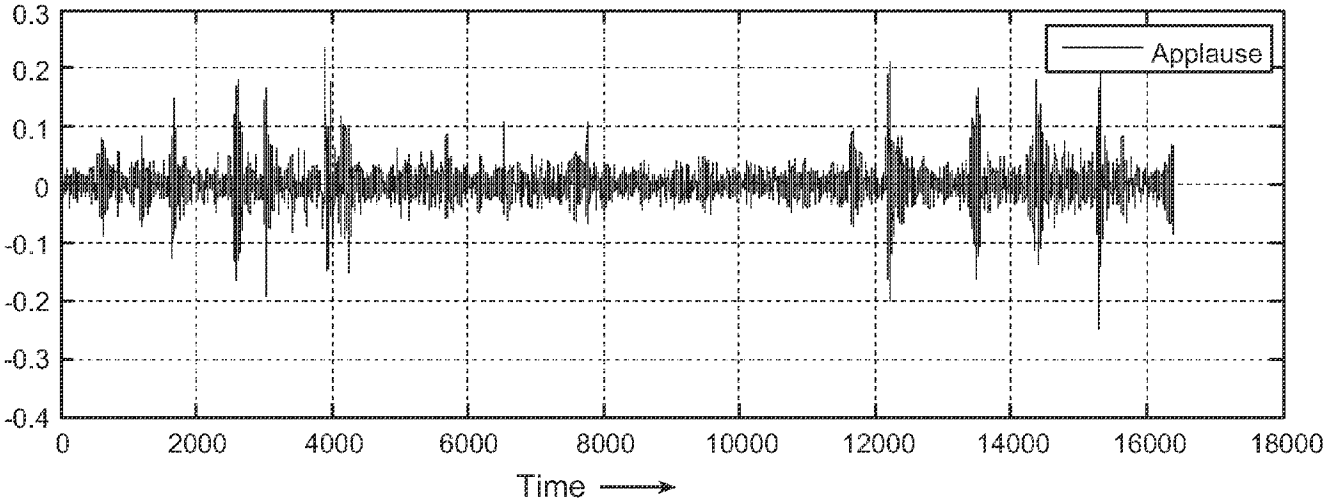
FIG. 14 is a graph of audience-generated sound (applause, whose magnitude is plotted versus time) of the type which may be produced by an audience during playback of an audiovisual program in a theater. It is an example of the audience-generated sound whose samples are identified in FIG. 13 as samples $d_j(n)$.

FIG. 14 is a graph of audience-generated sound (applause magnitude versus time) of the type which may be produced by an audience during playback of an audiovisual program in a theater. It is an example of the audience-generated sound whose samples are identified in FIG. 13 as samples $d_j(n)$.

Figure 15:
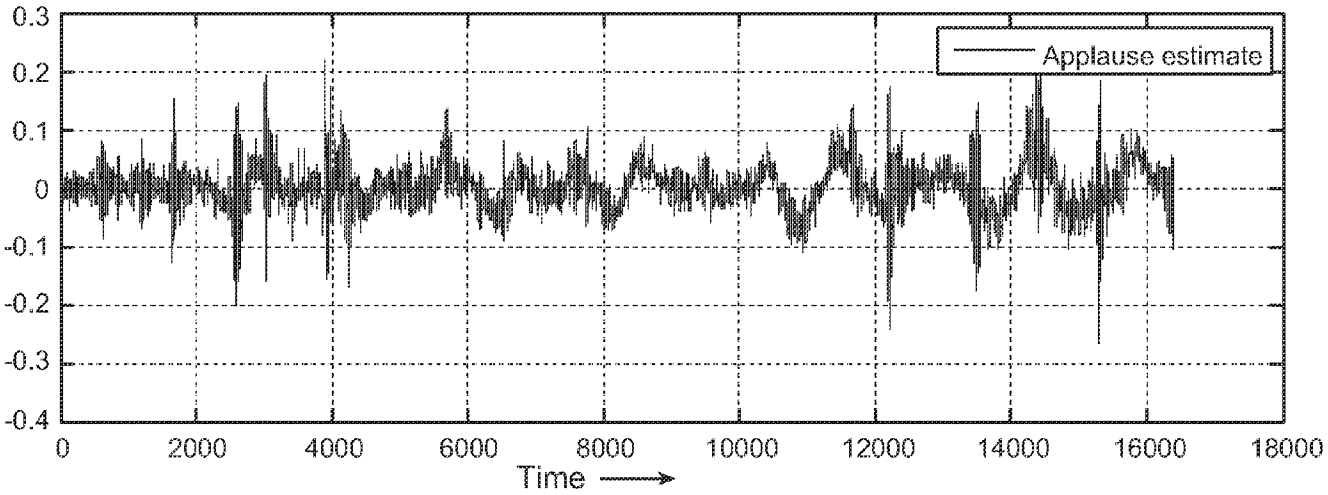
FIG. 15 is a graph of an estimate of the audience-generated sound of FIG. 14 (i.e., a graph of estimated applause, whose magnitude is plotted versus time), generated from the simulated output of a microphone (indicative of both the audience-generated sound of FIG. 14, and audio content of an audiovisual program being played back in the presence of an audience) in accordance with an embodiment of the present invention. It is an example of the audience-generated signal output from element 101 of the FIG. 13 system, whose samples are identified in FIG. 13 as samples $d'_j(n)$.

FIG. 15 is a graph of an estimate of the audience-generated sound of FIG. 14 (magnitude of estimated applause versus time), generated from the simulated output of a microphone (indicative of both the audience-generated sound of FIG. 14, and audio content of an audiovisual program being played back in the presence of an audience) in accordance with an embodiment of the present invention. The simulated microphone output was generated in a manner to be described below. The estimated signal of FIG. 15 is an example of the audience-generated signal output from element 101 of the FIG. 13 system, whose samples are identified in FIG. 13 as samples $d'_j(n)$, in the case of one microphone (j=1) and three speakers (i=1, 2, and 3), where the three room responses ($h_{ji}(n)$) are modified versions of the three room responses of FIG. 1.

More specifically, the room response for the Left speaker, $h_{j1}(n)$, is the "Left" channel speaker response plotted in FIG. 1, modified by addition of statistical noise thereto. The statistical noise (simulated diffuse reflections) was added to simulate the presence of the audience in the theater. To the "Left" channel response of FIG. 1 (which assumes that no audience is present in the room), simulated diffuse reflections were added after the direct sound (i.e., after the first 1200 or so samples of the "Left" channel response of FIG. 1) to model a statistical behavior of the room. This is reasonable since the strong specular room reflections (arising from wall reflections) will be modified only slightly in the presence of an audience (randomness). To determine the energy of the diffuse reflections to be added to the non-audience response (the "Left" channel response of FIG. 1) we looked at the energy of the reverberation tail of the non-audience response and scaled a zero mean Gaussian noise with this energy. The noise was then added to the portion of the non-audience response beyond the direct sound (i.e., the non-audience response was shaped by its own noisy part).

Similarly, the room response for the Center speaker, $h_{j2}(n)$, is the "Center" channel speaker response plotted in FIG. 1, modified by addition of statistical noise thereto. The statistical noise (simulated diffuse reflections) was added to simulate the presence of the audience in the theater. To the "Center" channel response of FIG. 1 (which assumes that no audience is present in the room), simulated diffuse reflections were added after the direct sound (i.e., after the first 1200 or so samples of the "Left" channel response of FIG. 1) to model a statistical behavior of the room. To determine the energy of the diffuse reflections to be added to the non-audience response (the "Center" channel response of FIG. 1) we looked at the energy of the reverberation tail of the non-audience response and scaled a zero mean Gaussian noise with this energy. The noise was then added to the portion of the non-audience response beyond the direct sound (i.e., the non-audience response was shaped by its own noisy part).

Similarly, the room response for the Right speaker, $h_{j3}(n)$, is the "Right" channel speaker response plotted in FIG. 1, modified by addition of statistical noise thereto. The statistical noise (simulated diffuse reflections) was added to simulate the presence of the audience in the theater. To the "Right" channel response of FIG. 1 (which assumes that no audience is present in the room), simulated diffuse reflections were added after the direct sound (i.e., after the first 1200 or so samples of the "Left" channel response of FIG. 1) to model a statistical behavior of the room. To determine the energy of the diffuse reflections to be added to the non-audience response (the "Right" channel response of FIG. 1) we looked at the energy of the reverberation tail of the non-audience response and scaled a zero mean Gaussian noise with this energy. The noise was then added to the portion of the non-audience response beyond the direct sound (i.e., the non-audience response was shaped by its own noisy part).

To generate the simulated microphone output samples, $m_j(n)$, that were asserted to one input of element 101 of FIG. 13, three simulated speaker output signals, $y_{ji}(n)$, where i=1, 2, and 3, were generated by convolution of the corresponding three channels of the program soundtrack, $x_1(n)$, $x_2(n)$, and $x_3(n)$, with the room responses ($h_{j1}(n)$, $h_{j2}(n)$, and $h_{j3}(n)$) described in the previous paragraph, and the results of the three convolutions were summed together and also summed with samples ($d_j(n)$) of the audience-generated sound of FIG. 14. Then, in element 101, estimated program content samples, $\check{z}_j(n)$, were subtracted from corresponding samples, $m_j(n)$, of the simulated microphone output, to generate the samples ($d'_j(n)$) of the estimated audience-generated sound signal (i.e., the signal graphed in FIG. 15). The estimated room responses, $\hat{h}_{ji}(n)$, employed by the FIG. 13 system to generate the estimated program content samples, $\check{z}_j(n)$, were the three room responses of FIG. 1. Alternatively, the estimated room responses, $\hat{h}_{ji}(n)$, employed to generate the samples, $\check{z}_j(n)$, could have been determined by adaptively updating the three initially determined room responses plotted in FIG. 1.

Aspects of the invention include a system configured (e.g., programmed) to perform any embodiment of the inventive method, and a computer readable medium (e.g., a disc) which stores code for implementing any embodiment of the inventive method. For example, such a computer readable medium may be included in processor 2 of FIG. 11.

In some embodiments, the inventive system is or includes at least one microphone (e.g., microphone 3 of FIG. 11) and a processor (e.g., processor 2 of FIG. 11) coupled to receive a microphone output signal from each said microphone. Each microphone is positioned during operation of the system to perform an embodiment of the inventive method to capture sound emitted from a set of speakers (e.g., the L, C, and R speakers of FIG. 11) to be monitored. Typically the sound is generated during playback of an audiovisual program (e.g., a movie trailer) in the presence of an audience in a room (e.g., a movie theater) by the speakers to be monitored. The processor can be a general or special purpose processor (e.g., an audio digital signal processor), and is programmed with software (or firmware) and/or otherwise configured to perform an embodiment of the inventive method in response to each said microphone output signal. In some embodiments, the inventive system is or includes a processor (e.g., processor 2 of FIG. 11), coupled to receive input audio data (e.g., indicative of output of at least one microphone in response to sound emitted from a set of speakers to be monitored). Typically the sound is generated during playback of an audiovisual program (e.g., a movie trailer) in the presence of an audience in a room (e.g., a movie theater) by the speakers to be monitored. The processor (which may be a general or special purpose processor) is programmed (with appropriate software and/or firmware) to generate (by performing an embodiment of the inventive method) output data in response to the input audio data, such that the output data are indicative of status of the speakers. In some embodiments, the processor of the inventive system is audio digital signal processor (DSP) which is a conventional audio DSP that is configured (e.g., programmed by appropriate software or firmware, or otherwise configured in response to control data) to perform any of a variety of operations on input audio data including an embodiment of the inventive method.

In some embodiments of the inventive method, some or all of the steps described herein are performed simultaneously or in a different order than specified in the examples described herein. Although steps are performed in a particular order in some embodiments of the inventive method, some steps may be performed simultaneously or in a different order in other embodiments.

While specific embodiments of the present invention and applications of the invention have been described herein, it will be apparent to those of ordinary skill in the art that many variations on the embodiments and applications described herein are possible without departing from the scope of the invention described and claimed herein. It should be understood that while certain forms of the invention have been shown and described, the invention is not to be limited to the specific embodiments described and shown or the specific methods described.

What is claimed is:

1. A method for monitoring status of N speakers in a playback environment, where N is a positive integer, said method including steps of:

(a) playing back an audiovisual program whose soundtrack has N channels, including by emitting sound, determined by the program, from the N speakers in response to driving each speaker of the N speakers with a speaker feed for a different one of the channels of the soundtrack;

(b) obtaining audio data indicative of a status signal captured by each microphone of M microphones in the playback environment during emission of the sound in step (a), where M is a positive integer; and (c) processing the audio data to perform a status check on each speaker of the N speakers, including by comparing, for each said speaker and each of at least one microphone in the M microphones, the status signal captured by the microphone and a template signal, wherein the template signal is indicative of response of a template microphone to playback by the speaker, in the playback environment at an initial time, of a channel of the soundtrack corresponding to said speaker.

2. The method of claim 1, wherein the audiovisual program is a movie trailer.

3. The method of claim 2, wherein the playback environment is a movie theater, and step (a) includes the step of playing back the trailer in the presence of an audience in the movie theater.

4. The method of claim 1, wherein the template microphone is positioned, at the initial time, at at least substantially the same position in the environment as is a corresponding microphone of the set during step (b).

5. The method of claim 1, wherein M=1, the audio data obtained in step (a) is indicative of a status signal captured by a microphone in the playback environment during emission of the sound in step (a), and the template microphone is said microphone.

6. The method of claim 1, wherein step (c) includes a step of determining, for each speaker-microphone pair consisting of one of the speakers and one said microphone, a cross-correlation of the template signal for said speaker and microphone with the status signal for said microphone.

7. The method of claim 6, wherein step (c) also includes a step of identifying, for each said speaker-microphone pair, a difference between the template signal for the speaker and the microphone of the pair and the status signal for said microphone, from a frequency domain representation of the cross-correlation for said speaker-microphone pair.

8. The method of claim 6, wherein step (c) also includes the steps of:

determining a cross-correlation power spectrum for each said speaker-microphone pair, from the cross-correlation for said speaker-microphone pair;

determining a smoothed cross-correlation power spectrum for each said speaker-microphone pair from the cross-correlation power spectrum for said speaker-microphone pair; and analyzing the smoothed cross-correlation power spectrum for at least one said speaker-microphone pair to determine status of the speaker of said pair.

9. The method of claim 1, wherein step (c) includes steps of:

for each speaker-microphone pair consisting of one of the speakers and one said microphone, applying a bandpass filter to the template signal for said speaker and microphone, and to the status signal for said microphone, thereby determining a bandpass filtered template signal and a bandpass filtered status signal; and determining, for each said speaker-microphone pair, a cross-correlation of the bandpass filtered template signal for said speaker and microphone with the bandpass filtered status signal for said microphone.

10. The method of claim 9, wherein step (c) also includes a step of identifying, for each speaker-microphone pair, a difference between the bandpass filtered template signal for the speaker and the microphone of the pair and the bandpass filtered status signal for said microphone, from a frequency domain representation of the cross-correlation for said speaker-microphone pair.

11. The method of claim 9, wherein step (c) also includes the steps of:

determining a cross-correlation power spectrum for each said speaker-microphone pair, from the cross-correlation for said speaker-microphone pair;

determining a smoothed cross-correlation power spectrum for each said speaker-microphone pair from the cross-correlation power spectrum for said speaker-microphone pair; and analyzing the smoothed cross-correlation power spectrum for at least one said speaker-microphone pair to determine status of the speaker of said pair.

12. The method of claim 1, wherein step (c) includes steps of:

determining, for each speaker-microphone pair consisting of one of the speakers and one said microphone, a sequence of cross-correlations of the template signal for said speaker and microphone with the status signal for said microphone, wherein each of the cross-correlations is a cross-correlation of a segment of the template signal for said speaker and microphone with a corresponding segment of the status signal for said microphone; and identifying a difference between the template signal for said speaker and microphone, and the status signal for said microphone, from an average of the cross-correlations.

13. The method of claim 1, wherein step (c) includes steps of:

for each speaker-microphone pair consisting of one of the speakers and one said microphone, applying a bandpass filter to the template signal for said speaker and microphone, and to the status signal for said microphone, thereby determining a bandpass filtered template signal and a bandpass filtered status signal;

determining, for each said speaker-microphone pair, a sequence of cross-correlations of the bandpass filtered template signal for said speaker and microphone with the bandpass filtered status signal for said microphone, wherein each of the cross-correlations is a cross-correlation of a segment of the bandpass filtered template signal for said speaker and microphone with a corresponding segment of the bandpass filtered status signal for said microphone; and identifying a difference between the bandpass filtered template signal for said speaker and microphone, and the bandpass filtered status signal for said microphone, from an average of the cross-correlations.

14. The method of claim 1, wherein M=1, the audio data obtained in step (a) is indicative of a status signal captured by a microphone in the playback environment during emission of the sound in step (a), the template microphone is said microphone, and step (c) includes a step of determining, for each speaker of the N speakers, a cross-correlation of the template signal for said speaker with the status signal.

15. The method of claim 14, wherein step (c) also includes a step of identifying, for each speaker of the N speakers, a difference between the template signal for said speaker and the status signal, from a frequency domain representation of the cross-correlation for said speaker.

16. The method of claim 1, wherein M=1, the audio data obtained in step (a) is indicative of a status signal captured by a microphone in the playback environment during emission of the sound in step (a), the template microphone is said microphone, and step (c) includes steps of:

for each speaker of the N speakers, applying a bandpass filter to the template signal for said speaker and to the status signal, thereby determining a bandpass filtered template signal and a bandpass filtered status signal; and determining, for each said speaker, a cross-correlation of the bandpass filtered template signal for said speaker with the bandpass filtered status signal.

17. The method of claim 16, wherein step (c) also includes a step of identifying, for each speaker of the N speakers, a difference between the bandpass filtered template signal for said speaker and the bandpass filtered status signal, from a frequency domain representation of the cross-correlation for said speaker.

18. The method of claim 1, wherein M=1, the audio data obtained in step (a) is indicative of a status signal captured by a microphone in the playback environment during emission of the sound in step (a), the template microphone is said microphone, and step (c) includes steps of:

determining, for each speaker of the N speakers, a sequence of cross-correlations of the template signal for said speaker with the status signal, wherein each of the cross-correlations is a cross-correlation of a segment of the template signal for said speaker with a corresponding segment of the status signal; and identifying a difference between the template signal for said speaker and the status signal, from an average of the cross-correlations.

19. The method of claim 1, wherein M=1, the audio data obtained in step (a) is indicative of a status signal captured by a microphone in the playback environment during emission of the sound in step (a), the template microphone is said microphone, and step (c) includes steps of:

for each speaker of the N speakers, applying a bandpass filter to the template signal for said speaker and to the status signal, thereby determining a bandpass filtered template signal and a bandpass filtered status signal;

determining, for said each speaker, a sequence of cross-correlations of the bandpass filtered template signal for said speaker with the bandpass filtered status signal, wherein each of the cross-correlations is a cross-correlation of a segment of the bandpass filtered template signal for said speaker with a corresponding segment of the bandpass filtered status signal; and identifying a difference between the bandpass filtered template signal for said speaker and the bandpass filtered status signal, from an average of the cross-correlations.

20. The method of claim 1, said method also including the steps of:

for each speaker-microphone pair consisting of one of the speakers and one template microphone of M template microphones in the playback environment, determining an impulse response of the speaker by measuring sound emitted from said speaker at the initial time with the template microphone; and for each of the channels, determining the convolution of the speaker feed for the channel with the impulse response of the speaker which is driven with said speaker feed in step (a), wherein said convolution determines the template signal employed in step (c) for the speaker-microphone pair employed to determine said convolution.

21. The method of claim 1, said method also including a step of:

for each speaker-microphone pair consisting of one of the speakers and one template microphone of M template microphones in the playback environment, driving the speaker at the initial time with the speaker feed which drives said speaker in step (a), and measuring the sound emitted from said speaker in response to said speaker feed with the template microphone, wherein the measured sound determines the template signal employed in step (c) for said speaker-microphone pair.

22. The method of claim 1, said method also including the steps of:

(d) for each speaker-microphone pair consisting of one of the speakers and one template microphone of M template microphones in the playback environment, determining an impulse response of the speaker by measuring sound emitted from said speaker at the initial time with the template microphone;

(e) for each of the channels, determining the convolution of the speaker feed for the channel with the impulse response of the speaker which is driven with said speaker feed in step (a); and (f) for each of the channels, determining a bandpass filtered convolution by applying a bandpass filter to the convolution determined in step (e) for the channel, wherein said bandpass filtered convolution determines the template signal employed in step (c) for the speaker-microphone pair employed to determine said bandpass filtered convolution.

23. The method of claim 1, said method also including the steps of:

(d) for each speaker-microphone pair consisting of one of the speakers and one template microphone of M template microphones in the playback environment, driving the speaker at the initial time with the speaker feed which drives said speaker in step (a), and employing the template microphone to generate a microphone output signal indicative of the sound emitted from said speaker in response to said speaker feed; and (e) for each speaker-microphone pair, determining a bandpass filtered microphone output signal by applying a bandpass filter to the microphone output signal generated in step (d), wherein said bandpass filtered microphone output signal determines the template signal employed in step (c) for the speaker-microphone pair employed to determine said bandpass filtered microphone output signal.

24. The method of claim 1, wherein step (c) includes, for each speaker-microphone pair consisting of one of the speakers and one said microphone, the steps of:

(d) determining cross-correlation power spectra for the speaker-microphone pair, where each of the cross-correlation power spectra is indicative of a cross-correlation of the speaker feed for the speaker of said speaker-microphone pair and the speaker feed for another one of the N speakers;

(e) determining an auto-correlation power spectrum indicative of an auto-correlation of the speaker feed for the speaker of said speaker-microphone pair;

(f) filtering each of the cross-correlation power spectra and the auto-correlation power spectrum with a transfer function indicative of a room response for the speaker-microphone pair, thereby determining filtered cross-correlation power spectra and a filtered auto-correlation power spectrum;

(g) comparing the filtered auto-correlation power spectrum to a root mean square sum of all the filtered cross-correlation power spectra; and (h) temporarily halting or slowing down the status check for the speaker of the speaker-microphone pair in response to determining that the root mean square sum is comparable to or greater than the filtered auto-correlation power spectrum.

25. The method of claim 24, wherein step (g) includes a step of comparing the filtered auto-correlation power spectrum and the root mean square sum on a frequency band-by-band basis, and step (h) includes a step of temporarily halting or slowing down the status check for the speaker of the speaker-microphone pair in each frequency band in which the root mean square sum is comparable to or greater than the filtered auto-correlation power spectrum.

26. A system for monitoring status of N speakers in a playback environment, where N is a positive integer, said system including:

M microphones positioned in the playback environment, where M is a positive integer; and a processor coupled to each of the M microphones, wherein the processor is configured to process audio data to perform a status check on each speaker of the N speakers, including by comparing, for each said speaker and each of at least one microphone in the M microphones, a status signal captured by the microphone and a template signal, wherein the template signal is indicative of response of a template microphone to playback by the speaker, in the playback environment at an initial time, of a channel of the sound track corresponding to said speaker, and wherein the audio data are indicative of a status signal captured by each microphone of the M microphones during playback of an audiovisual program whose soundtrack has N channels, wherein said playback of the program includes emission of sound determined by the program from the speakers in response to driving each speaker of the N speakers with a speaker feed for a different one of the channels of the soundtrack.

27. The system of claim 26, wherein the audiovisual program is a movie trailer, and the playback environment is a movie theater.

28. The system of claim 26, wherein the audio data are indicative of a status signal captured by a microphone in the playback environment during playback of the program, and the template microphone is said microphone.

29. The system of claim 26, wherein the processor is configured to determine, for each speaker-microphone pair consisting of one of the speakers and one said microphone, a cross-correlation of the template signal for said speaker and microphone with the status signal for said microphone.

30. The system of claim 29, wherein the processor is configured to identify, for each said speaker-microphone pair, a difference between the template signal for the speaker and the microphone of the pair and the status signal for said microphone, from a frequency domain representation of the cross-correlation for said speaker-microphone pair.

31. The system of claim 29, wherein the processor is configured to:

determine a cross-correlation power spectrum for each said speaker-microphone pair, from the cross-correlation for said speaker-microphone pair;

determine a smoothed cross-correlation power spectrum for each said speaker-microphone pair from the cross-correlation power spectrum for said speaker-microphone pair; and analyze the smoothed cross-correlation power spectrum for at least one said speaker-microphone pair to determine status of the speaker of said pair.

32. The system of claim 26, wherein the processor is configured to:

for each speaker-microphone pair consisting of one of the speakers and one said microphone, apply a bandpass filter to the template signal for said speaker and microphone, and to the status signal for said microphone, thereby determining a bandpass filtered template signal and a bandpass filtered status signal; and determine, for each said speaker-microphone pair, a cross-correlation of the bandpass filtered template signal for said speaker and microphone with the bandpass filtered status signal for said microphone.

33. The system of claim 26, wherein the processor is configured to identify, for each speaker-microphone pair, a difference between the bandpass filtered template signal for the speaker and the microphone of the pair and the bandpass filtered status signal for said microphone, from a frequency domain representation of the cross-correlation for said speaker-microphone pair.

34. The system of claim 32, wherein the processor is configured to:

determine a cross-correlation power spectrum for each said speaker-microphone pair, from the cross-correlation for said speaker-microphone pair;

determine a smoothed cross-correlation power spectrum for each said speaker-microphone pair from the cross-correlation power spectrum for said speaker-microphone pair; and analyze the smoothed cross-correlation power spectrum for at least one said speaker-microphone pair to determine status of the speaker of said pair.

35. The system of claim 26, wherein the processor is configured to:

determine, for each speaker-microphone pair consisting of one of the speakers and one said microphone, a sequence of cross-correlations of the template signal for said speaker and microphone with the status signal for said microphone, wherein each of the cross-correlations is a cross-correlation of a segment of the template signal for said speaker and microphone with a corresponding segment of the status signal for said microphone; and identify a difference between the template signal for said speaker and microphone, and the status signal for said microphone, from an average of the cross-correlations.

36. The system of claim 26, wherein the processor is configured to:

for each speaker-microphone pair consisting of one of the speakers and one said microphone, apply a bandpass filter to the template signal for said speaker and microphone, and to the status signal for said microphone, thereby determining a bandpass filtered template signal and a bandpass filtered status signal;

determine, for each said speaker-microphone pair, a sequence of cross-correlations of the bandpass filtered template signal for said speaker and microphone with the bandpass filtered status signal for said microphone, wherein each of the cross-correlations is a cross-correlation of a segment of the bandpass filtered template signal for said speaker and microphone with a corresponding segment of the bandpass filtered status signal for said microphone; and identify a difference between the bandpass filtered template signal for said speaker and microphone, and the bandpass filtered status signal for said microphone, from an average of the cross-correlations.

37. The system of claim 26, wherein M=1, the audio data are indicative of a status signal captured by a microphone in the playback environment during playback of the program, the template microphone is said microphone, and the processor is configured to determine, for each speaker of the N speakers, a cross-correlation of the template signal for said speaker with the status signal.

38. The system of claim 37, wherein the processor is configured to identify, for each speaker of the N speakers, a difference between the template signal for said speaker and the status signal, from a frequency domain representation of the cross-correlation for said speaker.

39. The system of claim 26, wherein M=1, the audio data are indicative of a status signal captured by a microphone in the playback environment during playback of the program, the template microphone is said microphone, and the processor is configured to:

for each speaker of the N speakers, apply a bandpass filter to the template signal for said speaker and to the status signal, thereby determining a bandpass filtered template signal and a bandpass filtered status signal; and determine, for each said speaker, a cross-correlation of the bandpass filtered template signal for said speaker with the bandpass filtered status signal.

40. The system of claim 39, wherein the processor is configured to identify, for each speaker of the N speakers, a difference between the bandpass filtered template signal for said speaker and the bandpass filtered status signal, from a frequency domain representation of the cross-correlation for said speaker.

41. The system of claim 26, wherein M=1, the audio data are indicative of a status signal captured by a microphone in the playback environment during playback of the program, the template microphone is said microphone, and the processor is configured to:

determine, for each speaker of the N speakers, a sequence of cross-correlations of the template signal for said speaker with the status signal, wherein each of the cross-correlations is a cross-correlation of a segment of the template signal for said speaker with a corresponding segment of the status signal; and identify a difference between the template signal for said speaker and the status signal, from an average of the cross-correlations.

42. The system of claim 26, wherein M=1, the audio data are indicative of a status signal captured by a microphone in the playback environment during playback of the program, the template microphone is said microphone, and the processor is configured to:

for each speaker of the N speakers, apply a bandpass filter to the template signal for said speaker and to the status signal, thereby determining a bandpass filtered template signal and a bandpass filtered status signal;

determine, for said each speaker, a sequence of cross-correlations of the bandpass filtered template signal for said speaker with the bandpass filtered status signal, wherein each of the cross-correlations is a cross-correlation of a segment of the bandpass filtered template signal for said speaker with a corresponding segment of the bandpass filtered status signal; and identify a difference between the bandpass filtered template signal for said speaker and the bandpass filtered status signal, from an average of the cross-correlations.

43. The system of claim 26, wherein the processor is configured to:

for each speaker-microphone pair consisting of one of the speakers and one template microphone of M template microphones in the playback environment, determine an impulse response of the speaker by measuring sound emitted from said speaker at the initial time with the template microphone; and for each of the channels, determine the convolution of the speaker feed for the channel with the impulse response of the speaker which is driven with said speaker feed during capture of the status signal, wherein said convolution determines the template signal for the speaker-microphone pair employed to determine said convolution.

44. The system of claim 26, wherein the processor is configured to:

determine, for each speaker-microphone pair consisting of one of the speakers and one template microphone of M template microphones in the playback environment, an impulse response of the speaker in response to sound measured from said speaker at the initial time with the template microphone;

determine, for each of the channels, the convolution of the speaker feed for the channel with the impulse response of the speaker which is driven with said speaker feed during capture of the status signal; and determine, for each of the channels, a bandpass filtered convolution by applying a bandpass filter to the convolution determined for the channel, wherein said bandpass filtered convolution determines the template signal for the speaker-microphone pair employed to determine said bandpass filtered convolution.

* * * * *